US008860542B2

(12) United States Patent
Yoshikawa et al.

(10) Patent No.: US 8,860,542 B2
(45) Date of Patent: Oct. 14, 2014

(54) REACTOR, REACTOR MANUFACTURING METHOD, AND REACTOR COMPONENT

(75) Inventors: Kouhei Yoshikawa, Osaka (JP); Yoshiaki Matsutani, Yokkaichi (JP); Takahiro Onizuka, Yokkaichi (JP); Akinori Ooishi, Yokkaichi (JP); Satoru Ando, Yokkaichi (JP)

(73) Assignees: Sumitomo Electric Industries, Ltd., Osaka-shi (JP); Sumitomo Wiring Systems, Ltd., Yokkaichi-shi (JP)

( * ) Notice: Subject to any disclaimer, the term of this patent is extended or adjusted under 35 U.S.C. 154(b) by 0 days.

(21) Appl. No.: 13/979,916

(22) PCT Filed: Feb. 8, 2012

(86) PCT No.: PCT/JP2012/052826

§ 371 (c)(1),
(2), (4) Date: Jul. 16, 2013

(87) PCT Pub. No.: WO2012/111499

PCT Pub. Date: Aug. 23, 2012

(65) Prior Publication Data

US 2013/0293335 A1 Nov. 7, 2013

(30) Foreign Application Priority Data

Feb. 14, 2011 (JP) ..... 2011-028649

(51) Int. Cl.
*H01F 27/29* (2006.01)

(52) U.S. Cl.
USPC ..... 336/192

(58) Field of Classification Search
USPC ..... 336/65, 83, 96, 200, 232–234, 192
See application file for complete search history.

(56) References Cited

U.S. PATENT DOCUMENTS

| | | | |
|---|---|---|---|
| 4,112,481 | A | 9/1978 | Roge et al. |
| 6,392,519 | B1 | 5/2002 | Ronning |
| 2009/0144967 | A1 | 6/2009 | Hasu et al. |

FOREIGN PATENT DOCUMENTS

| | | |
|---|---|---|
| JP | 2004-095570 | 3/2004 |
| JP | 2008-112753 | 5/2008 |

(Continued)

OTHER PUBLICATIONS

International Search Report in International Application No. PCT/JP2012/052826, dated May 22, 2012.

(Continued)

*Primary Examiner* — Tuyen Nguyen

(74) *Attorney, Agent, or Firm* — Venable LLP; Michael A. Sartori; F. Brock Riggs

(57) ABSTRACT

A reactor being small in size and exhibiting excellent productivity, a method for manufacturing the same, and a reactor component suitable as the constituent component of the reactor are provided. The reactor includes a combined product including a coil and a magnetic core, and a case storing the combined product. The case includes a bottom plate portion made of aluminum, a side wall portion made of an insulating resin, and a joining layer formed on the inner face of the bottom plate portion for fixing the coil. The bottom plate portion and the side wall portion are independent separate members, which are integrated with each other by bolts and the like. Terminal fittings having a pair of joining pieces, which are disposed at the positions opposing to the end portions of the wire structuring the coil, are fixed to the side wall portion. Since each end portion of the wire is interposed in the space formed by the joining pieces, the wire and the terminal fittings can be electrically connected to each other without the necessity of using a separate jig. Since the joining layer is made of an adhesive agent exhibiting excellent thermal conductivity and insulation, the reactor possesses an excellent heat dissipating characteristic.

13 Claims, 6 Drawing Sheets

(56) References Cited

FOREIGN PATENT DOCUMENTS

| | | | | |
|---|---|---|---|---|
| JP | 2008-305854 | | | 12/2008 |
| JP | 2009-099596 | | | 5/2009 |
| JP | 2009267197 | A | * | 11/2009 |
| JP | 2010-045111 | | | 2/2010 |
| JP | 2011-243943 | A | | 12/2011 |
| WO | WO-2010/021113 | A1 | | 2/2010 |

OTHER PUBLICATIONS

Office Action in U.S. Appl. No. 13/882,397, dated Jun. 4, 2014.

* cited by examiner (A)

(B)

(C)

REACTOR, REACTOR MANUFACTURING METHOD, AND REACTOR COMPONENT

TECHNICAL FIELD

The present invention relates to a reactor used as a constituent component of a power converter apparatus such as an in-vehicle DC-DC converter installed in a vehicle such as a hybrid vehicle, a method for manufacturing the same, and a reactor component. In particular, the present invention relates to a reactor being small in size and possessing an excellent heat dissipating characteristic and exhibiting excellent productivity.

BACKGROUND ART

One of the components of a circuit that steps up or steps down voltage is a reactor. For example, Patent Literature 1 discloses a reactor that is used in a converter installed in a vehicle such as a hybrid vehicle. The reactor includes a coil made of a wound wire, an annular magnetic core where the coil is disposed, a case storing a combined product made up of the coil and the magnetic core, and a sealing resin with which the case is filled. Terminal fittings are respectively attached to the end portions of the wire structuring the coil. The coil is supplied with power from an external apparatus such as a power supply via the terminal fittings. Generally, the reactor is used as being fixed to a cooling base for cooling the coil and the like, which produce heat when being energized.

The representative case is a die casting product made of aluminum. The case is used as being fixed to the cooling base to serve as a heat dissipation path for dissipating heat from the coil and the like.

CITATION LIST

Patent Literature

Patent Literature 1: Japanese Unexamined Patent Publication No. 2010-045111

SUMMARY OF INVENTION

Technical Problem

In recent years, a further reduction in size and weight is desired for in-vehicle components of a hybrid vehicle and the like. However, such a further reduction in size is difficult to achieve with the reactor which includes the conventional aluminum case.

Since aluminum is an electrically conductive material, the aluminum case must be electrically insulated at least from the coil. Accordingly, normally, a relatively great interval is provided between the coil and the inner face (the bottom face and the sidewall face) of the case, in order to secure an electrical insulating distance. In consideration of securing the insulating distance, a reduction in size is difficult with the reactor including an aluminum case.

For example, a reduction in size of the reactor can be achieved by eliminating the case. However, this will expose the coil and the magnetic core. Therefore, the coil and the magnetic core cannot be protected from the external environment such as dust and corrosion, or provided with mechanical protection such as strength.

Further, an improvement in attachment workability of the terminal fittings is desired. In the case where the portion of each terminal fitting being brought into contact with the end portion of the wire is flat as the terminal fitting disclosed in Patent Literature 1, the terminal fitting and the end portion of the wire may not fully be brought into contact with each other, or may totally fail to be brought into contact, depending on the manufacturing error. In this case, until the terminal fitting and the wire are fully electrically connected and fixed to each other through welding or soldering, it is necessary to hold the terminal fitting and the end portion of the wire by a clamping jig or the like, to perform welding or soldering in the state where the terminal fitting and the end portion of the wire are surely in contact with each other. Though use of such a jig can ultimately join the terminal fitting and the wire to each other, a reduction in productivity of the reactor is invited because of the preparation or arrangement of the jig.

Accordingly, one object of the present invention is to provide a reactor that is small in size and exhibits an excellent productivity. Further, another object of the present invention is to provide a reactor manufacturing method according to which the reactor can be manufactured highly productively. Still further, still another object of the present invention is to provide a reactor component preferable as the constituent component of the reactor.

Solution to Problem

The present invention achieves the objects stated above by: (1) structuring the case as a dividable component made up of a bottom plate portion and a side wall portion; (2) including a joining layer that fixes the coil to a portion structuring the inner bottom face of the case; and (3) fixing terminal fittings of a particular shape to the side wall portion.

The reactor of the present invention includes a combined product and a case storing the combined product, the combined product including a coil made of a wound wire and a magnetic core where the coil is disposed. The case includes a bottom plate portion and a side wall portion, which is independent of the bottom plate portion. The bottom plate portion is brought into contact with a fixation target when the reactor is installed in the fixation target. The side wall portion is integrated with the bottom plate portion by a fixation member. Further, the side wall portion is disposed to surround the periphery of the combined product. The case includes a joining layer that is formed at one face of the bottom plate portion to fix the coil to the bottom plate portion, and a terminal fitting that is fixed to the side wall portion. An end portion of the wire structuring the coil is electrically connected to the terminal fitting. The terminal fitting has, on its one end side, a plurality of joining pieces that are disposed at positions opposing to the end portion of the wire. The end portion of the wire is interposed in a space formed by the joining pieces.

In manufacturing the reactor of the present invention, for example, the following reactor manufacturing method of the present invention can be suitably used. In manufacturing a reactor by: preparing a combined product made up of a coil and a magnetic core by assembling the coil made of a wound wire and the magnetic core; and storing the combined product in a case, which includes a bottom plate portion and a side wall portion provided to stand upright from the bottom plate portion, the reactor manufacturing method of the present invention includes the following steps of: preparing the side wall portion; preparing the bottom plate portion; fixing the coil; disposing the side wall portion; assembling the case; and joining the terminal fitting and the wire to each other.

Preparing the side wall portion: preparing a side wall portion to which a terminal fitting is fixed, the terminal fitting including a plurality of joining pieces disposed at positions opposing to an end portion of the wire structuring the coil.

Preparing the bottom plate portion: preparing a bottom plate portion exclusive of the side wall portion, the bottom plate portion including a joining layer at its one face.

Fixing the coil: placing the combined product on the bottom plate portion including the joining layer, and fixing the coil to the bottom plate portion by the joining layer.

Disposing the side wall portion: disposing the side wall portion on the bottom plate portion so as to surround the periphery of the combined product, and disposing the terminal fitting such that the end portion of the wire is interposed in a space formed by the joining pieces.

Assembling the case: attaching the side wall portion to the bottom plate portion by a fixation member to form the case.

Joining the terminal fitting and the wire to each other: electrically connecting at least one of the joining pieces and the end portion of the wire to each other without use of a jig for bringing the joining piece and the end portion of the wire into contact to each other.

Note that, the order of performing the preparation of the side wall portion and the preparation of the bottom plate portion is not limited, and they can be performed in parallel. Further, the order of performing the preparation of the side wall portion and the fixing of the coil is not limited, and they can be performed in parallel.

As a constituent component of the reactor of the present invention, for example, the following reactor component of the present invention can be suitably used. The reactor component of the present invention is used as a constituent component of a case for storing a combined product including a coil made of a wound wire and a magnetic core where the coil is disposed. The case includes a bottom plate portion and a side wall portion provided to stand upright from the bottom plate portion. The reactor component of the present invention includes: a side wall portion that is disposed to surround the periphery of the combined product when the combined product is stored; and a terminal fitting to which an end portion of the wire structuring the coil is electrically connected when the combined product is stored. The side wall portion is independent of the bottom plate portion, and is attached to the bottom plate portion by a fixation member to structure the case. The bottom plate portion includes a joining layer for fixing the coil. The terminal fitting is fixed to the side wall portion. Further, the terminal fitting includes, on its one end side, a plurality of joining pieces that are disposed at positions opposing to the end portion of the wire.

With the reactor of the present invention and the reactor component of the present invention, since the end portion of the wire is interposed in the space formed by the joining pieces disposed to oppose to each other, for example, in electrically connecting the terminal fitting and the end portion of the wire to each other through welding or soldering, the end portion of the wire can be clamped by the plurality of joining pieces automatically or through caulking as appropriate. Accordingly, being different from the conventional manner, no jig (such as the clamping jig noted above) for bringing the end of the wire and the terminal fitting into contact with each other fully is required in establishing the electrical connection. Alternatively, since the end portion of the wire is interposed in the space formed by the joining piece, an electrical connection can be established with ease between the terminal fitting and the end portion of the wire by allowing solder to be packed between the terminal fitting and the wire. Hence, caulking or use of any jig noted above is not required. Accordingly, the reactor of the present invention and the reactor component of the present invention provide excellent attachment workability as to the terminal fitting.

Further, with the reactor of the present invention and the reactor component of the present invention, the terminal fitting of the particular shape is fitted to the side wall portion. Therefore, in forming the case, when the side wall portion is disposed on the bottom plate portion, the end portion of the wire can be automatically interposed between the joining pieces of the terminal fitting. Further, depending on the shape of the terminal fitting, the end portion of the wire and at least one of the joining pieces can be automatically brought into contact with each other, or can be brought into contact under pressure. From this viewpoint also, the reactor of the present invention provides excellent attachment workability as to the terminal fitting. The reactor component of the present invention can contribute toward an increase in productivity of the reactor of the present invention. According to the manufacturing method of the present invention, the reactor of the present invention can be manufactured highly productively.

In addition, in connection with the reactor of the present invention, the bottom plate portion and the side wall portion are separate members and, therefore, they can be separately manufactured. Thus, the manufacturing mode is highly flexible. For example, the joining layer can be formed at the bottom plate portion in the state where the side wall portion is removed. Here, with the conventional case in which the bottom face and sidewall are integrally molded and cannot be separated from each other, a joining layer can be formed, for example, at the inner bottom face where the coil can be brought into contact with. However, in this case, the sidewall becomes an obstacle to form the joining layer with ease. In contrast thereto, with the reactor of the present invention and the manufacturing method of the present invention, the joining layer can be formed at the bottom plate portion in the state where no side wall portion is provided, and excellent workability can be achieved. Alternatively, in forming an integrated product in which the terminal fitting is fixed to the side wall portion, the terminal fitting can be integrally molded with the side wall portion through injection molding in forming the side wall portion, or the integrated product can be formed using tightening members such as bolts. When integral molding is employed, since the number of pieces of components or assembly steps is small, productivity of the reactor of the present invention can be improved. In the case where the tightening members such as bolts are used, since components such as the terminal fitting can be replaced or changed with ease, excellent maintainability and ease of design change of the reactor of the present invention are obtained. Furthermore, in connection with the reactor of the present invention, provision of the case makes it possible to protect the coil and the magnetic core from the environment, and to achieve mechanical protection. Further, with the reactor of the present invention, since the joining layer is included to bring the coil into contact with the case, a reduction in size of the case can be achieved.

In one mode of the reactor of the present invention, the end portion of the wire is in contact with at least one of the joining pieces.

In this mode, as described above, welding or soldering can be performed in establishing an electrical connection without use of any jig such as a conventional clamping jig. Thus, excellent attachment workability of the terminal fitting is obtained.

In one mode of the reactor of the present invention, the end portion of the wire and at least one of the joining pieces are electrically connected to each other through one of welding and soldering.

In the mode in which the end portion of the wire is interposed in the space formed by the joining pieces disposed to oppose to each other, there is a clearance between the joining pieces and the end portion of the wire, and the joining pieces and the end portion of the wire are not in contact with each other. Thus, an electrical connection may not be fully established. In this mode, the state in which the joining pieces disposed to oppose to each other and the end portion of the wire are in direct contact with each other is secured through welding or soldering. Alternatively, in the mode noted above, an electrical connection is established by the solder being interposed between the joining pieces arranged to oppose to each other and the end portion of the wire. Accordingly, both of the modes realize a highly reliable electrical connection.

In one mode of the reactor of the present invention, the joining layer has a multilayer structure including an adhesive layer structured with an insulating adhesive agent and a heat dissipation layer. Further, the bottom plate portion is structured with an electrically conductive material. In this mode, the adhesive layer is disposed on the side to be brought into contact with the coil, and the heat dissipation layer is disposed on the side being brought into contact with the bottom plate portion.

In this mode, the coil is fixed to the bottom plate portion by the joining layer including the heat dissipation layer. That is, the face of the coil that becomes the installation side when the reactor is installed in the fixation target (hereinafter referred to as the coil installation face) is in close proximity to the heat dissipation layer, or more preferably, is in contact therewith. Accordingly, in this mode, the heat of the coil can be more efficiently transferred to the heat dissipation layer, and released to the fixation target such as a cooling base via the heat dissipation layer. Therefore, an excellent heat dissipating characteristic can be obtained. In particular, since the joining layer includes the adhesive layer, in which at least the side being brought into contact with the coil installation face is structured with an insulating material, even when the heat dissipation layer or the bottom plate portion is structured with an electrically conductive material, the coil and the bottom plate portion can be surely insulated from each other, by allowing the coil to be brought into contact with the adhesive layer. Accordingly, the joining layer including the heat dissipation layer can be reduced in thickness. From this viewpoint also, the heat of the coil can be easily released to the fixation target. Thus, this mode provides an excellent heat dissipating characteristic. In particular, with the reactor of the present invention, since the bottom plate portion and the side wall portion are made of separate members, they can be made of different materials. For example, employing the bottom plate portion made of a material higher in thermal conductivity than the side wall portion, the reactor possessing a further excellent heat dissipating characteristic can be obtained.

Further, in this mode, provision of the heat dissipation layer makes it possible to efficiently dissipate heat at least from the coil installation face via the heat dissipation layer, as described above. Therefore, for example, when the manner in which the case is filled with a sealing resin is employed, the heat dissipating characteristic can be secured by the heat dissipation layer even when the resin being poor in thermal conductivity is used. Accordingly, this mode realizes higher flexibility in selecting a sealing resin that can be used. For example, the resin containing no filler can be used as the sealing resin. Alternatively, even when the mode including no sealing resin is employed, the heat dissipation layer can provide an adequate heat dissipating characteristic.

Further, in this mode, since the thickness of the joining layer including the heat dissipation layer is reduced as described above, the interval between the coil installation face and the inner face of the bottom plate portion can be reduced, and a further reduction in size can be achieved. In particular, in connection with the reactor of the present invention, the material of the bottom plate portion and that of the side wall portion can be different from each other as described above. Therefore, for example, employing a material possessing an excellent electrical insulating characteristic as the material of the side wall portion, the interval between the outer circumferential face of the coil and the inner circumferential face of the side wall portion can be reduced, and hence the reactor being further smaller in size can be implemented.

The joining layer can be a single-layer structure made of an insulating material, or it can be a multilayer structure including a layer made of an insulating material. With the single-layer structure, formation work of the joining layer is simple; with the multilayer structure, insulation between the coil and the bottom plate portion can be secured with ease. In particular, when the multilayer structure made of an identical material is employed, the thickness per layer can be reduced, and the joining layer can be formed with ease; when the multilayer structure made of different materials is employed, it becomes possible to obtain a plurality of characteristics, which may be selected from: insulation between the coil and the bottom plate portion; adhesion between them; performance of dissipating heat from the coil to the bottom plate portion and the like. In this mode, what is included is the joining layer having the multilayer structure made up of the adhesive layer and the heat dissipation layer. For example, employing an adhesive agent (e.g., an epoxy base adhesive agent) being excellent in adhesion strength than the heat dissipation layer as the material of the adhesive layer, and employing a material (e.g., an epoxy base adhesive agent containing an alumina filler) being excellent in thermal conductivity than the adhesive layer as the material of the heat dissipation layer, adhesion between the coil and the joining layer can be enhanced. By the adhesion, the heat of the coil can be efficiently transferred to the heat dissipation layer. It goes without saying that different adhesive agents may be employed for the adhesive layer and the heat dissipation layer (in the example noted above, the epoxy base adhesive agent). Further, in this mode, since the adhesive layer is structured with the insulating adhesive agent, the bottom plate portion made of an electrically conductive material and the coil can be fully insulated despite a reduction in thickness of the adhesive layer. This reduction in thickness also contributes toward facilitating transfer of heat from the coil to the heat dissipation layer. Further, employing the mode in which the heat dissipation layer also is made of an insulating material, the electrical insulating characteristic can be further enhanced. Even when the thickness per layer is reduced, an excellent electrical insulating characteristic can be obtained thanks to the joining layer having the multilayer structure. In addition, the material of at least one of the adhesive layer and the heat dissipation layer can be replaced by insulating sheet.

Here, when the joining layer is reduced in thickness as much as possible, the distance between the coil and the bottom plate portion can be reduced. Therefore, a reduction in size of the reactor can be achieved, and the heat dissipating characteristic can be enhanced as described above. However, when the joining layer is reduced in thickness, pinhole may be produced. In contrast, employing the multilayer structure in which the joining layer is made of an insulating material, a pinhole in a certain layer can be closed by the adjacent separate layer. Thus, the joining layer possessing excellent insulating performance can be obtained. The thickness per layer and the number of pieces of layers can be arbitrarily selected. The greater the total thickness, the higher the insulating performance; and the smaller the total thickness, the higher the heat dissipating performance. When the materials structuring the layer exhibit excellent insulating performance, adequate heat dissipating characteristic and insulating performance can be obtained even if each layer is thin and the number of the layers is small. For example, the joining layer may have the total thickness of less than 2 mm; furthermore, 1 mm or less; and particularly, 0.5 mm or less.

Further, in this mode, when the bottom plate portion is made of an electrically conductive material, representatively, metal such as aluminum, magnesium, or the alloy of aluminum or magnesium, the heat dissipating characteristic of the reactor can be further enhanced, because such metal generally possesses an excellent heat dissipating characteristic.

In the mode in which the joining layer is the multilayer structure including the adhesive layer and the heat dissipation layer, at least part of the heat dissipation layer is structured with a material whose thermal conductivity is higher than 2 W/m·K.

Since the heat dissipation layer is made of the material exhibiting high thermal conductivity, the reactor possessing a further higher heat dissipating characteristic can be obtained.

In the mode in which the joining layer has the multilayer structure including the adhesive layer and the heat dissipation layer, the heat dissipation layer is structured with an epoxy base adhesive agent including an alumina filler, and the bottom plate portion is made of aluminum or aluminum alloy.

The epoxy base adhesive agent containing an alumina filler is excellent in both the insulating characteristic and the heat dissipating characteristic. For example, it can satisfy the condition of the thermal conductivity being 3 W/m·K or more. Accordingly, in accordance with the mode, a further excellent heat dissipating characteristic can be achieved. Further, in this mode, since the entire joining layer is made of the insulating adhesive agent, excellent insulation can be provided.

The insulating adhesive agent structuring the adhesive layer may also be the adhesive agent including the filler. In this case, what is obtained is the joining layer having the multilayer structure made of one type of material. It goes without saying that the insulating adhesive agent structuring the adhesive layer may be made of a material which is not the adhesive agent including the filler. In either manner, in this mode, since each layer structuring the joining layer is made of the insulating adhesive agent, excellent effects such as follows are exhibited: a high electrical insulating characteristic can be secured even when each layer is reduced in thickness as described above; a reduction in thickness of each layer can achieve a reduction in size of the reactor as described above; and an enhancement of the heat dissipating characteristic can be achieved.

Further, aluminum or aluminum alloy is high in thermal conductivity (aluminum: 237 W/m·K). Accordingly, according to the present mode including the bottom plate portion made of aluminum or the like, the heat of the coil can efficiently be released to the fixation target such as a cooling base using the bottom plate portion as the heat dissipation path. Thus, a further excellent heat dissipating characteristic can be achieved.

In one mode of the reactor of the present invention, the side wall portion is made of an insulating material.

In this mode, since the side wall portion is structured with an insulating material, the side wall portion and the coil are insulated from each other. Therefore, the interval between the inner face of the side wall portion and the outer circumferential face of the coil can be narrowed. Thus, a further reduction in size can be achieved. Further, when the insulating material is made of material being lighter than a metal material, such as resin, the case being lighter than a conventional aluminum case can be obtained. Note that, as described above, similarly to the bottom plate portion, the side wall portion can be structured with an electrically conductive material such as aluminum or magnesium, or alloy of aluminum or magnesium. In this case, the heat dissipating characteristic can be enhanced. Further, since the case is made of an electrically conductive and non-magnetic material, the case functions as a magnetic shield, whereby leakage flux can be suppressed.

In one mode of the reactor of the present invention, the terminal fitting is integrally molded with the side wall portion.

In this mode, the terminal fitting can be integrated when the side wall portion is formed. Therefore, as compared to the case where the side wall portion and the terminal fitting are integrated through tightening members such as bolts, a reduction in the number of components or assembly steps can be achieved.

In one mode of the reactor of the present invention, the bottom plate portion is equal to or higher than the side wall portion in thermal conductivity.

In this mode, since the bottom plate portion is structured with a material whose thermal conductivity is equal to or higher than that of the side wall portion, the heat from the coil installation face can be effectively released to the bottom plate portion via the heat dissipation layer. Thus, an excellent heat dissipating characteristic can be obtained.

In one mode of the reactor of the present invention, the terminal fitting is formed with a plate member made of an electrically conductive material being bent. The reactor further includes a guide portion provided between one end side region having the joining pieces and a fixation region being fixed to the side wall portion, the guide portion guiding the end portion of the wire such that at least one of the joining pieces and the end portion of the wire are brought into contact with each other.

When the terminal fitting is formed with a plate member being bent through press working or the like, the terminal fitting of a variety of shape can be formed with ease. Further, in this mode, the end portion of the wire can be automatically brought into contact with at least one of the joining pieces by the guide portion. The guide portion may be, for example, the curve portion that is formed between the one end side region and the fixation region and that is bent at a particular angle with a prescribed curvature. In this case, in disposing the end portion of the wire between the joining pieces of the terminal fitting, when the end portion of the wire is allowed to strike the curve portion, the end portion of the wire is guided toward the one end side region along the curvature, and ultimately inserted between the joining pieces. Depending on the magnitude of the curvature or the angle, the interval between the joining pieces, or the mode of them, the end portion of the wire inserted between the joining pieces can be automatically brought into contact with, or into contact under pressure with, at least one of the joining pieces. Accordingly, the contact or the contact under pressure between the joining piece and the end portion of the wire can be maintained, without the necessity of performing work such as caulking as described above.

In one mode of the reactor component of the present invention, the joining pieces have a narrow portion where an interval between the joining pieces is smaller than the thickness of the wire.

In this mode, in disposing the end portion of the wire at the terminal fitting, allowing the end portion of the wire to be inserted into the narrow portion, the end portion of the wire is automatically brought into contact under pressure with the narrow portion. In this manner, since the end portion of the wire is clamped by the joining pieces, the contact state of the end portion of the wire and the joining piece is not easily released when they are subjected to joining such as welding. Thus, the joining work can be stably performed. Employing the structure in which the narrow portion is included together with the guide portion described above, it becomes easier to introduce the end portion of the wire between the joining pieces. Furthermore, the clamped state can be secured.

Advantageous Effects of Invention

The reactor of the present invention is small in size and exhibits excellent heat dissipating performance and productivity. The reactor component of the present invention can contribute toward an improvement in the productivity of the reactor of the present invention. The reactor manufacturing method of the present invention makes it possible to highly productively manufacture the reactor of the present invention, which is small in size and exhibits excellent heat dissipating performance.

BRIEF DESCRIPTION OF DRAWINGS

FIG. 3 (A) is a front view of one of the terminal fittings; and FIG. 3 (B) is a plan view; and FIG. 3 (C) is a perspective view.

DESCRIPTION OF EMBODIMENTS

Figure 1:
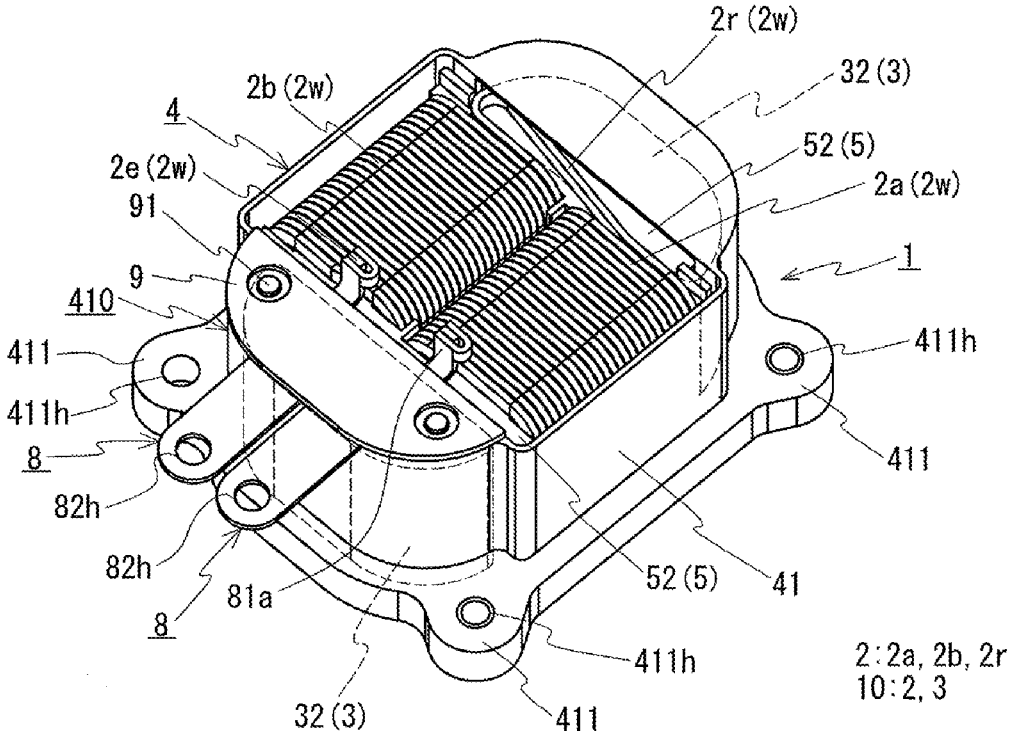
FIG. 1 is a schematic perspective view showing a reactor according to an embodiment.

In the following, with reference to FIGS. 1 to 5, a description will be given of embodiments of the present invention. In the drawing, identical reference symbols are allotted to identically named elements. Note that, in the following description, the installed side when the reactor is installed is regarded to be the bottom side, and the side opposite thereto is regarded to be the top side.

<<Overall Structure>>

The reactor 1 includes: a combined product 10 made up of a coil 2 formed with a wire 2*w* and a magnetic core 3 around which the coil 2 is disposed; and a case 4 storing the combined product 10. The case 4 is a box-like element whose one face is open. Representatively, the case 4 is filled with a sealing resin (not shown), and the combined product 10 is buried in the sealing resin except for the end portions 2*e* of the wire. To each of the end portions 2*e* of the wire, terminal fitting 8 is attached so that power is supplied to the coil 2 via the terminal fitting 8. The reactor 1 is characterized in that the case 4 is a combination of a plurality of independent members, and in the shape of each terminal fitting 8. In the following, the constituent members will be described in more detail.

<<Combined Product>>

[Coil]

A description will be given of the coil 2 with reference to FIGS. 2 and 4. The coil 2 includes a pair of coil elements 2*a* and 2*b* made of a single continuous wire 2*w* with no joined portion being spirally wound, and a coil couple portion 2*r* coupling the coil elements 2*a* and 2*b*. The coil elements 2*a* and 2*b* are identical to each other in the number of turns. The shape of each of the coil elements 2*a* and 2*b* as seen in the axial direction (i.e., the end face shape) is substantially quadrangular (i.e., a rectangular shape with rounded corners). The coil elements 2*a* and 2*b* are laterally juxtaposed to each other such that their respective axial directions are in parallel to each other. On the other end side of the coil 2 (on the depth side in FIG. 2), the wire 2*w* is partially bent in a U-shape, to form the coil couple portion 2*r*. Thus, the coil elements 2*a* and 2*b* are structured to be wound in the identical direction.

The wire 2*w* is suitably a coated wire, which includes a conductor made of an electrically conductive material such as copper or aluminum, or alloy of the copper or aluminum, the conductor being provided with an insulating coat made of an insulating material around its outer circumference. Here, what is used is a coated rectangular wire whose conductor is a copper-made rectangular wire and the insulating coat is made of enamel (polyamide-imide, representatively). The thickness of the insulating coat is preferably 20 μm or more and 100 μm or less. As the thickness is greater, the pinholes become fewer, whereby the electrical insulating characteristic is enhanced. The coil elements 2*a* and 2*b* are each the coated rectangular wire being wound edgewise, to be formed into a hollow square sleeve-like shape. The wire 2*w* is not limited to those whose conductor is a rectangular wire, and wires of various shapes whose cross section is circular, elliptical, polygonal and the like may be used. As compared to the case where a round wire whose cross section is circular is used, with the rectangular wire, a coil being high in space factor can be formed easier. Further, use of the rectangular wire makes it possible to easily secure the wider contact area with a joining layer 42, whose description will be given later, as compared to the case where a round wire is used. This is because the face of the coil 2 serving as the installation side when the reactor 1 is installed in the fixation target (hereinafter referred to as the coil installation face; the bottom face in FIGS. 2 and 4) substantially has the area based on the product of the thickness and the number of turns of the rectangular wire. Further, with the rectangular wire, the joining area with the terminal fitting 8 can be secured with ease while maintaining the shape of the rectangular wire as it is. Note that, it is also possible to employ the mode in which the coil elements are prepared from separate wires, and the end portions of the wires forming respective coil elements are joined by welding or soldering, to obtain an integrated coil.

The opposite end portions 2*e* of the wire forming the coil 2 are appropriately drawn out from the turn forming portion on one end side (i.e., the near side in FIG. 2) of the coil 2 to the outside of the case 4 (FIG. 1). The drawn out opposite end portions 2*e* of the wire have the conductor portions exposed outside, by the insulating coat being peeled off. To each of the exposed conductor portions, the terminal fitting 8 made of an electrically conductive material is connected. Via the terminal fitting 8, an external apparatus (not shown) such as a power supply supplying power to the coil 2 is connected. The terminal fitting 8 will be detailed later.

[Magnetic Core]

A description will be given of the magnetic core 3 with reference to FIG. 4. The magnetic core 3 includes a pair of inner core portions 31 around which the coil elements 2*a* and 2*b* are respectively disposed, and a pair of outer core portions 32 around which no coil 2 is disposed and hence exposed outside the coil 2. Here, the inner core portions 31 are each a rectangular parallelepiped-shaped (with rounded corners in the embodiment), and the outer core portions 32 are each a prism element having a pair of trapezoidal-shaped faces. The magnetic core 3 is structured such that the outer core portions 32 clamp the inner core portions 31, which are disposed to be away from each other. Further, the end faces 31*e* of the inner core portions 31 and the inner end faces 32*e* of the outer core portions 32 are brought into contact to each other, so as to form an annular shape. When the coil 2 is excited, the inner core portions 31 and the outer core portions 32 form a closed magnetic path.

The inner core portions 31 are lamination products in which core pieces 31*m* made of a magnetic material and gap members 31*g* representatively made of a non-magnetic material are alternately laminated, while the outer core portions 32 are each a core piece made of a magnetic material. The core pieces 31*m* and the gap members 31*g* can be integrated by, for example, applying an adhesive agent or wrapping around an adhesion tape, so as to be joined. Further, what can be employed is the mode in which an adhesive agent is used in forming the inner core portions 31, while no adhesive agent is used in joining the inner core portions 31 and the outer core portions 32 to each other. Here, no adhesive agent is used in joining the core pieces 31*m* and the gap members 31*g*.

The core pieces may each be a molded product made of magnetic powder, or a lamination product made up of a plurality of magnetic thin plates (e.g., electromagnetic steel sheet) provided with insulating coating being laminated. The exemplary molded product may be: a powder magnetic core using powder of: iron group metal such as Fe, Co, Ni and the like, Fe-base alloy such as Fe—Si, Fe—Ni, Fe—Al, Fe—Co, Fe—Cr, Fe—Si—Al and the like, rare-earth metal, or a soft magnetic material such as an amorphous magnetic element; a sintered product obtained by sintering the above-noted powder having undergone press molding; and a hardened mold product obtained by subjecting a mixture of the above-noted powder and resin to injection molding, cast molding and the like. In addition, each core piece may be a ferrite core being a sintered product of a metal oxide. With the molded product, magnetic cores of various three-dimensional shapes can easily be formed.

As the powder magnetic core, what can suitably be used is the powder of the soft magnetic material noted above, with its surface being provided with an insulating coating. In this case, the powder magnetic core is obtained by molding the powder and thereafter subjecting the molded powder to thermal treatment at a temperature equal to or lower than the heat resistant temperature of the insulating coating. Representative insulating coating may be those made of silicone resin, phosphate or the like.

The inner core portions 31 and the outer core portions 32 may be different from each other in material. For example, when the inner core portions 31 are the powder magnetic cores or the lamination products while the outer core portions 32 are the hardened mold products, the saturation magnetic flux density of the inner core portions 31 can easily be increased to be higher than that of the outer core portions 32. Here, the core pieces are powder magnetic cores of soft magnetic powder containing iron such as iron or steel.

The gap members 31*g* are each a plate-like member disposed at the clearance, which is provided between the core pieces 31*m* for the purpose of adjusting inductance. The material of the gap members 31*g* is those having permeability lower than that of the core pieces, such as alumina, glass epoxy resin, unsaturated polyester and the like. Representatively, the material of the gap members 31*g* is a non-magnetic material (in some cases, each gap member is an air gap). In addition, employing a mixture material in which magnetic powder (e.g., ferrite, Fe, Fe—Si, Sendust) is dispersed in a non-magnetic material such as ceramic or phenolic resin for the gap members 31*g*, the leakage flux occurring at the gap portion can be suppressed.

The number of pieces of the core pieces or the gap members can appropriately be selected such that the reactor 1 obtains the desired inductance. Further, the shape of the core pieces or the gap members can appropriately be selected. Here, though the description is given of the mode in which each inner core portion 31 includes a plurality of core pieces 31*m* and a plurality of gap members 31*g*, the gap member may be provided by one in number. Further, depending on the material of the core pieces, the gap members can be dispensed with. Still further, though the description is given of the mode in which each outer core portion 32 is structured by a single core piece, the outer core portion 32 may be structured by a plurality of core pieces. In the case where the core pieces are structured by powder magnetic cores, employing the mode in which a plurality of core pieces structure the inner core portions and the outer core portions, each of the core pieces can be reduced in size. Therefore, excellent moldability is achieved.

In addition, employing the structure in which a coating layer made of an insulating material is provided at the outer circumference of the inner core portion 31, insulation between the coil 2 and the inner core portion 31 can be enhanced. The coating layer may be provided by, for example, disposing a heat shrink tubing or a cold shrink tubing, an insulating tape or insulating paper or the like. By disposing the shrink tubing at the outer circumference of each inner core portion 31 or bonding the insulating tape thereto, integration of the core pieces and the gap members can also be achieved in addition to an improvement in insulation, without use of any adhesive agent. Further, the shrink tubing or the insulating tape can be used in place of an insulator 5 (surrounding wall portion 51), which will be described later.

In connection with the magnetic core 3 shown in the present embodiment, the faces of the inner core portions 31 on the installation side and the faces of the outer core portions 32 on the installation side are not flush with each other. Specifically, when the reactor 1 is installed in the fixation target, the faces of the outer core portions 32 on the installation side (hereinafter referred to as the core installation face; the bottom faces in FIG. 4) project further than the faces of the inner core portions 31 on the installation side. Here, the height of the outer core portions 32 (the length in the direction perpendicular to the surface of the fixation target in the state where the reactor 1 is installed in the fixation target (here, the direction being perpendicular to the axial direction of the coil 2; the top-bottom direction in FIG. 4)) is adjusted such that the core installation faces of the outer core portions 32 and the coil installation face of the coil 2 become flush with each other, and the faces (the top faces in FIG. 4) opposing to the installation side of the inner core portions 31 and the faces (the top faces in FIG. 4) of the outer core portion 32 opposing to the core installation faces become flush with each other. Accordingly, when the magnetic core 3 is seen from sideways in the state where the reactor 1 is installed, the magnetic core 3 is inverted U-shaped. Further, since the core installation face and the coil installation face are flush with each other, not only the coil installation face of the coil 2, but also the core installation face of the magnetic core 3 can be brought into contact with the joining layer 42 (FIG. 2), which will be described later. Further, in the state where the magnetic core 3 is assembled in an annular shape, the side faces of the outer core portions 32 (the faces on the near and depth sides in FIG. 4) project outward than the side faces of the inner core portions 31. Accordingly, in the state where the reactor is installed (i.e., in the state where the bottom side is the installation side in FIG. 4), the magnetic core 3 is H-shaped as seen from the top face or the bottom face. By structuring the magnetic core 3 having such a three-dimensional shape as the powder magnetic core, its shape is easily formed, and the portion in the outer core portions 32 projecting further than the inner core portions 31 can also be used as the path of the magnetic flux. Further, since the core installation face and the coil installation face are flush with each other, the installation face of the reactor 1 becomes great. Hence, the combined product 10 can be installed stably.

[Insulator]

Figure 4:
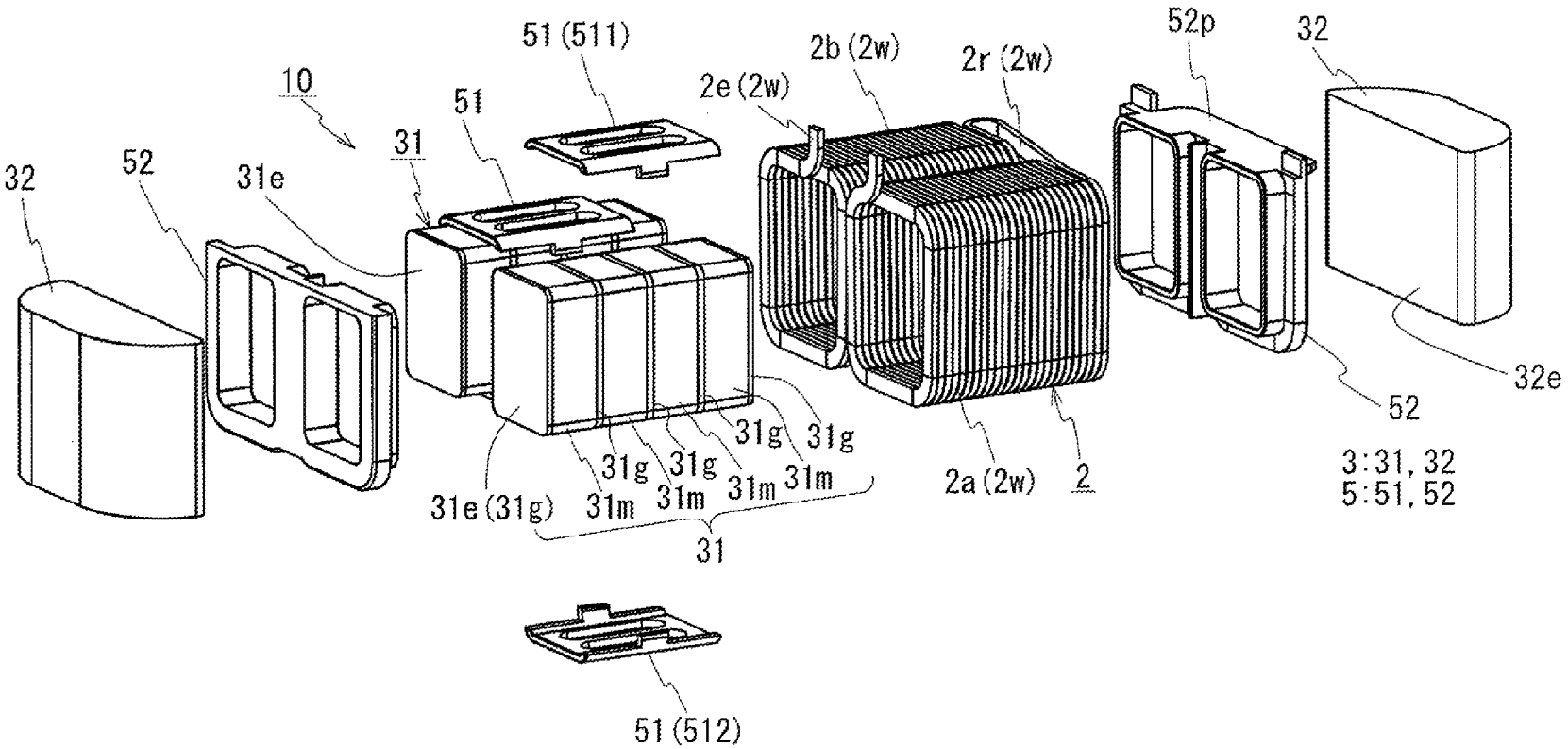
FIG. 4 is an exploded perspective view showing the overview of a combined product made up of a coil and a magnetic core included in the reactor according to the embodiment.

As shown in FIG. 4, the combined product 10 includes the insulator 5 between the coil 2 and the magnetic core 3, such that insulation between the coil 2 and the magnetic core 3 is enhanced. The insulator 5 may be structured to include a surrounding wall portion 51 disposed on the outer circumference of the inner core portion 31 and a pair of frame-like portions 52 abutting on the end faces (i.e., the faces where the turns of each coil element is shown in an annular manner) of the coil 2.

The surrounding wall portion 51 is interposed between the inner circumferential face of the coil 2 and the outer circumferential face of the inner core portion 31, to thereby insulate the coil 2 and the inner core portion 31 from each other. Here, the surrounding wall portion 51 is structured with a pair of divided pieces 511 and 512 each having a ]-shaped cross section. The divided pieces 511 and 512 are not in contact with each other, and the divided pieces 511 and 512 are disposed at only part of the outer circumferential face of the inner core portions 31 (herein, mainly the face on the installation side of the inner core portion 31 and the face opposing thereto). Though the surrounding wall portion 51 may be formed as a sleeve-like element disposed along the entire circumference of the outer circumferential face of the inner core portions 31 (see FIG. 6 whose description will follow), part of the inner core portions 31 may not be covered by the surrounding wall portions 51 as shown in FIG. 4, so long as the insulating distance between the coil 2 and the inner core portion 31 can be secured. Further, in this case, the surrounding wall portion 51 is provided with window portions penetrating through the front surface to the back surface.

Since part of the inner core portions 31 is exposed outside the surrounding wall portion 51, the material of the insulator 5 can be reduced. Further, in the mode in which the sealing resin is included, employing the structure including the divided pieces 511 and 512 having the window portions, or employing the structure in which not the entire circumference of the inner core portions 31 is covered by the surrounding wall portion 51, the contact area between the inner core portions 31 and the sealing resin can be increased. Furthermore, the foregoing structures facilitate the bubbles to dissipate when the sealing resin is poured. Thus, excellent manufacturability of the reactor 1 can be obtained.

Each of the frame-like portions 52 is interposed between the end face of the coil 2 and the inner end face 32*e* of corresponding outer core portion 32, to insulate the coil 2 and the outer core portion 32 from each other. Each frame-like portion 52 has a flat plate-like body portion. The body portion is a B-shaped element having a pair of opening portions into which the inner core portions 31 are respectively inserted. Here, in order to facilitate introduction of the inner core portions 31, short sleeve-like portions that continue from the opening portions of the body portion to project toward the inner core portion 31 are provided. Further, one frame-like portion 52 (the right one in FIG. 4) is provided with a pedestal 52*p* for placing the coil couple portion 2*r* and for insulating the coil couple portion 2*r* and the outer core portion 32 from each other.

As the material of the insulator 5, an insulating material such as polyphenylene sulfide (PPS) resin, polytetrafluoroethylene (PTFE) resin, polybutylene terephthalate (PBT) resin, liquid crystal polymer (LCP) and the like can be used. It is also possible to employ the structure excluding the insulator 5.

<<Case>>

A description of the case 4 will be given with reference to FIG. 2. The case 4 storing the combined product 10 made up of the coil 2 and the magnetic core 3 includes a flat plate-like bottom plate portion 40 and a frame-like side wall portion 41 provided to stand upright from the bottom plate portion 40. Some of the characteristics of the reactor 1 are as follows: the bottom plate portion 40 and the side wall portion 41 are not integrally molded but are independent of each other, and being integrated by fixation members; the bottom plate portion 40 is provided with the joining layer 42; and the terminal fittings 8 each having a particular shape are fixed to the side wall portion 41.

[Bottom Plate Portion and Side Wall Portion]

(Bottom Plate Portion)

The bottom plate portion 40 is a quadrangular plate, and is fixed to a fixation target to be in contact therewith, when the reactor 1 is installed in the fixation target. Though the example in FIG. 2 shows the installation state where the bottom plate portion 40 is on the bottom side, in other possible installation state, the bottom plate portion 40 may be positioned on the top side, or may be oriented sideways. The bottom plate portion 40 is provided with the joining layer 42 at one face, which is located inside when the case 4 is assembled. The outer shape of the bottom plate portion 40 can be appropriately selected. Here, the bottom plate portion 40 has attaching portions 400 respectively projecting from the four corners. The outer shape of the bottom plate portion 40 is designed to conform to the outer shape of the side wall portion 41, which will be described later. When the bottom plate portion 40 and the side wall portion 41 are combined to form the case 4, the attaching portions 400 overlap with attaching portions 411 of the side wall portion 41. The attaching portions 400 are each provided with a bolt hole 400*h* through which a bolt (not shown) for fixing the case 4 to the fixation target is inserted. The bolt holes 400*h* are provided so as to be continuous to bolt holes 411*h*, which will be described later, of the side wall portion 41. The bolt holes 400*h* and 411*h* may each be a through hole not being threaded or may be a screw hole being threaded. The number of pieces of the bolt holes 400*h* and 411*h* can arbitrarily be selected.

Alternatively, it is also possible to employ the mode in which the side wall portion 41 is provided with no attaching portions, and the bottom plate portion 40 solely is provided with the attaching portions 400. In this case, the outer shape of the bottom plate portion 40 is formed such that the attaching portions 400 of the bottom plate portion 40 project from the outer shape of the side wall portion 41. Alternatively, it is also possible to employ the mode in which the side wall portion 41 solely is provided with the attaching portions 411, and the bottom plate portion 40 is provided with no attaching portions. In this mode, the outer shape of the side wall portion 41 is formed such that the attaching portions 411 of the side wall portion 41 project from the outer shape of the bottom plate portion 40.

(Side Wall Portion)

The side wall portion 41 is a quadrangular frame-like element. The side wall portion 41 is disposed to surround the combined product 10 when the case 4 is assembled, while having its one opening portion closed by the bottom plate portion 40 and the other opening portion being opened. Here, in connection with the side wall portion 41, when the reactor 1 is disposed at the fixation target, the region becoming the installation side is quadrangular conforming to the outer shape of the bottom plate portion 40, and the region on the opening side is in a curved plane shape conforming to the outer circumferential face of the combined product 10 made up of the coil 2 and the magnetic core 3. In the state where the case 4 is assembled, the outer circumferential face of the coil 2 and the inner circumferential face of the side wall portion 41 are in close proximity to each other. The interval between the outer circumferential face of the coil 2 and the inner circumferential face of the side wall portion 41 is very narrow, i.e., about 0 mm to 1.0 mm. Further, in the present embodiment, in the region on the opening side of the side wall portion 41, an overhanging portion is provided so as to cover the trapezoidal face of the outer core portion 32 of the combined product 10. In connection with the combined product 10 stored in the case 4, as shown in FIG. 1, the coil 2 is exposed, and the magnetic core 3 is substantially covered by the constituents of the case 4. Provision of the overhanging portion brings about various effects such as (1) an improvement in resistance to vibrations, (2) an improvement in rigidity of the case 4 (side wall portion 41), (3) protection of the combined product 10 from the external environment, achievement of mechanical protection, and the like. It is also possible to dispense with the overhanging portion such that both the coil 2 and the trapezoidal face of at least one of the outer core portions 32 are exposed.

[Attaching Place]

The region on the installation side of the side wall portion 41 is provided with the attaching portions 411 respectively projecting from the four corners, similarly to the bottom plate portion 40. The attaching portions 411 are respectively provided with the bolt holes 411*h*. Each bolt hole 411*h* may be formed solely with the material of the side wall portion 41, or may be formed by disposing a tubular element made of a different material thereto. For example, in the case where the side wall portion 41 is structured with resin as will be described later, employing a metal pipe made of, for example, metal such as brass, steel, or stainless steel as the tubular element, excellent strength is exhibited, and hence creep deformation of the resin can be suppressed. Here, a metal pipe is disposed to form each bolt hole 411*h*.

[Terminal Block]

In the region on the opening side of the side wall portion 41, at the portion covering above the one outer core portion 32, a pair of terminal fitting 8, which will be described later, is fixed, to function as a terminal block 410. Firstly, a description will be given of the terminal fittings 8.

[Terminal Fitting]

The terminal fittings 8 will be described with reference to FIGS. 2 and 3. Each terminal fitting 8 to which corresponding end portion 2*e* of the wire 2*w* structuring the coil 2 is connected is an electrically conductive member, which is an appropriately bent plate member made of an electrically conductive material such as copper, copper alloy, aluminum, aluminum alloy or the like. To one end side of the terminal fitting 8, the end portion 2*e* of the wire is joined through soldering or welding. To the other end side, an external apparatus such as a power supply is connected. Thus, supply of power to the coil 2 is enabled.

Each terminal fitting 8 includes, at the intermediate region between one end side region and other end side region, a fixation region 80*f* to be fixed to the side wall portion 41. The other end side region to which the external apparatus is connected and the fixation region 80*f* are continuous plate-like, as shown in FIG. 3 (B). The one end side region to which the wire is connected is bent at right angle (90°) relative to the other end side region and the fixation region 80*f* so as to stand upright, as shown in FIGS. 3 (A) and 3 (C). The portion between the one end side region and the fixation region 80*f* is in a curved shape having a prescribed curvature (FIG. 3 (A)).

The terminal fittings 8 are identical to each other in the basic structure. Here, in the state where the case 4 is assembled, the intermediate regions of the terminal fittings 8 are formed to take shapes being different from each other, such that the one end sides of the terminal fittings 8 are disposed so as to respectively correspond to the positions of the end portions 2*e* of the wire, and the other end sides of the terminal fittings 8 are in close proximity to each other. More specifically, as shown in FIG. 3 (B), in connection with the one terminal fitting 8 (the one on the top side in FIG. 3 (B)), the one end side region and the other end side region are displaced from each other in the horizontal direction. It goes without saying that the terminal fittings 8 may be of the identical shape.

To the one end side of each terminal fitting 8, a pair of joining pieces 81*a* and 81*b* is provided at the positions opposing to the end portion 2*e* of the wire (here, on the front and back surfaces of the wire 2*w* being a coated rectangular wire). That is, what is provided at the one end side of each terminal fitting 8 is the pair of joining pieces 81*a* and 81*b*. The joining pieces 81*a* and 81*b* are opposed to each other as being away from each other by interval $C_{81}$ with which the end portion 2*e* of the wire can be received. Between the pair of joining pieces 81*a* and 81*b*, the end portion 2*e* of the wire can be accommodated.

Here, part of the plate member is bent to be U-shaped. The joining pieces 81*a* and 81*b* are quadrangular pieces that are coupled via a curve portion and that are disposed in parallel to each other. The length $L_{81}$ may be common to the joining pieces 81*a* and 81*b* as shown in the present embodiment, or may be different. In the present embodiment, though a pair of joining pieces is provided, three or more joining pieces may be provided. In the case where three or more joining pieces are provided, the number of joining pieces arranged at the opposite position may be different. In the case where the wire 2*w* is made of a round wire, the joining pieces are arranged to oppose to each other in the diameter direction of the round wire.

The interval $C_{81}$ between the joining pieces 81*a* and 81*b* can be selected as appropriate. For example, the interval $C_{81}$ may be substantially identical to the thickness of the wire 2*w* for over the entire region in the direction of width $W_{81}$ of each of the plate pieces structuring the joining pieces 81*a* and 81*b* (in the present embodiment, this mode is employed). In this mode, by allowing the end portion 2*e* of the wire to be inserted between the joining pieces 81*a* and 81*b*, the end portion 2*e* of the wire is interposed in the U-shaped space formed by the joining pieces 81*a* and 81*b* and the portion connecting between the joining pieces 81*a* and 81*b*. Furthermore, the front and back surfaces of the end portion 2*e* of the wire can automatically be brought into contact with the joining pieces 81*a* and 81*b*. Further, the end portion 2*e* of the wire is maintained in the state being clamped by the joining pieces 81*a* and 81*b* and in contact therewith. Accordingly, in this mode, the joining area between the end portion 2*e* of the wire and the joining pieces 81*a* and 81*b* can surely be secured. Furthermore, the contact state can be maintained even during joining work such as welding without the necessity of using a jig separately. In this mode and a mode including an enlarged portion, which will be described later, for example, by allowing the joining pieces 81*a* and 81*b* to be caulked in the state where the end portion 2*e* of the wire is interposed in the space formed by the joining pieces 81*a* and 81*b* before being subjected to joining such as welding or soldering, the end portion 2*e* of the wire can fully be brought into contact under pressure with the joining pieces 81*a* and 81*b*. Alternatively, in this mode and the mode including the enlarged portion, which will be described later, by providing an appropriate guide portion as will be described later, one face of the end portion 2*e* of the wire can be brought into contact under pressure with at least one of the joining pieces 81*a* and 81*b*.

It is possible to employ the mode, which includes an enlarged portion where the interval $C_{81}$ is greater than the thickness of the wire 2*w* at part in width $W_{81}$ direction of the plate piece structuring each of the joining pieces 81*a* and 81*b*, while the other portion is substantially equivalent to the thickness of the wire 2*w*. The position where the enlarged portion is to be formed can be selected as appropriate. For example, in the case where the enlarged portion is provided on the side where the end portion 2*e* of the wire is inserted (on the bottom side in FIGS. 3 (A) and 3 (C)) when the side wall portion 41 is to be disposed on the bottom plate portion 40, the insertion of the end portion 2*e* of the wire is facilitated, and an improvement in assemblability can be achieved. Further, in this mode, as described above, the front and back surfaces of the end portion 2*e* of the wire inserted between the joining pieces 81*a* and 81*b* can be brought into contact with the joining pieces 81*a* and 81*b*, except for the enlarged portion. Therefore, similarly to the mode in which the relationship, i.e., interval $C_{81} \cong$ thickness of the wire 2*w*, is established, sufficient contact area can be secured and the contact state can be maintained. The enlarged portion can be formed easily by, for example, subjecting prescribed portions of the joining pieces 81*a* and 81*b* to grinding and cutting.

It is also possible to set the entire region in the width $W_{81}$ direction of the plate piece structuring each of the joining pieces 81*a* and 81*b* as the enlarged portion. In this case, insertion of the end portion 2*e* of the wire is further facilitated. Further, this mode can be easily achieved just by setting the interval $C_{81}$ to be greater than the thickness of the wire 2*w*. In this mode, when the terminal fittings 8 are merely disposed, the end portion 2*e* of the wire is only interposed in the space formed by the joining pieces 81*a* and 81*b*, and the end portion 2*e* of the wire and the joining pieces 81*a* and 81*b* are not in contact with each other. However, by allowing solder to be packed between the end portion 2*e* of the wire, which is interposed in the space formed by the joining pieces 81*a* and 81*b*, and the joining pieces 81*a* and 81*b*, the end portion 2*e* of the wire and the joining pieces 81*a* and 81*b* can be electrically connected to each other. Alternatively, by allowing the joining pieces 81*a* and 81*b* to be caulked, the end portion 2*e* of the wire can be fully brought into contact under pressure with the joining pieces 81*a* and 81*b*.

It is also possible to employ a mode in which the interval $C_{81}$ has a narrow portion being smaller than the thickness of the wire 2*w* in at least part of the portion in the width $W_{81}$ direction of the plate piece structuring each of the joining pieces 81*a* and 81*b*. In this mode, as the end portion 2*e* of the wire is inserted between the joining pieces 81*a* and 81*b* when the side wall portion 41 is to be disposed on the bottom plate portion 40, the end portion 2*e* of the wire is clamped by the narrow width portion, to be automatically brought into contact under pressure with the joining pieces 81*a* and 81*b*. Further, the clamped state is not easily released by the narrow width portion. Setting the entire region in the width $W_{81}$ direction of the plate piece structuring each of the joining pieces 81*a* and 81*b* to be the narrow portion, it becomes possible to secure the clamped state of the end portion 2*e* of the wire by the joining pieces 81*a* and 81*b* and to secure an adequate contact area. On the other hand, when the narrow portion is provided partially as described above, insertion of the end portion 2*e* of the wire is facilitated, whereby an improvement in workability can be achieved. In particular, in the case where the narrow portion is partially provided, insertion of the end portion 2*e* of the wire is further facilitated by setting the other portions to be the enlarged portion.

The curve portion 83 that is provided between the fixation region 80*f* and the joining pieces 81*a* and 81*b* of each terminal fitting 8 and that has a prescribed curvature serves as a guide portion, which function as a guide in introducing the end portion 2*e* of the wire between the joining pieces 81*a* and 81*b*. When the side wall portion 41 is to be disposed on the bottom plate portion 40, as the end portion 2*e* of the wire strikes the curve portion 83, one face of the end portion 2*e* of the wire is guided toward the joining pieces 81*a* and 81*b* along a flat portion 85 continuing to one joining piece 81*a*, and ultimately introduced between the joining pieces 81*a* and 81*b*. Then, the end portion 2*e* of the wire is interposed in the space formed by the joining pieces 81*a* and 81*b*. In the present embodiment, one face of the end portion 2*e* of the wire is in contact with the flat portion 85 and the joining piece 81*a*, while the other face of the end portion 2*e* of the wire is in contact with the joining piece 81*b*. Provision of the guide portion in this manner makes it possible to allow at least one face of the end portion 2*e* of the wire to be automatically brought into contact with at least one of the joining pieces 81*a* and 81*b*.

In the present embodiment, the interior angle (bending angle) formed by the one end side region having the joining pieces 81*a* and 81*b* and the fixation region 80*f* may be defined to be 90°, and the curve portion 83 having a curvature may be defined to be the guide portion. In addition, the bending angle may be an acute angle (less than 90°, e.g., 45° to) 80° or an obtuse angle (greater than 90°, e.g., 100° to 135°). It goes without saying that the bending angle may be defined to fall within a range of 90°±10°. When the bending angle is defined to be an acute angle, it becomes possible to cause the joining pieces 81*a* and 81*b* projecting further than the flat portion 85 themselves to function as the guide portion. Specifically, when the side wall portion 41 is to be disposed on the bottom plate portion 40, the end portion 2*e* of the wire striking the curve portion 83 straightly extends its course toward the joining pieces 81*a* and 81*b*. Then, the end portion 2*e* of the wire is guided by the one joining piece 81*b* to be introduced between the joining pieces 81*a* and 81*b*. On the other hand, when the bending angle is defined to be an obtuse angle, it becomes possible to cause the flat portion 85 to function as the guide portion. Specifically, when the side wall portion 41 is to be disposed on the bottom plate portion 40, the end portion 2*e* of the wire does not strike the curve portion 83 but strikes the flat portion 85, and is guided toward the joining pieces 81*a* and 81*b* along the inclined flat portion 85, to be introduced between the joining pieces 81*a* and 81*b*. Irrespective of the bending angle being an acute angle or an obtuse angle, the end portion 2*e* of the wire introduced between the joining pieces 81*a* and 81*b* is pressed against one joining piece between the joining pieces 81*a* and 81*b*. That is, the end portion 2*e* of the wire is in contact under pressure with one of the joining pieces 81*a* and 81*b*. Thus, by devising the shape of the terminal fitting 8, the curve portion 83 having a curvature, the inclined flat portion 85, or the joining piece itself can be used as the guide portion. Further, at least one face of the end portion 2*e* of the wire can automatically be brought into contact (contact under pressure) with at least one of the joining pieces 81*a* and 81*b*.

In establishing an electrical connection between the conductor portion of the end portion 2*e* of the wire and the joining pieces 81*a* and 81*b* of the terminal fitting 8, welding such as TIG welding, soldering, attaching under pressure or the like can be used. In the present embodiment, since the state in which the end portion 2*e* of the wire and at least one of the joining pieces 81*a* and 81*b* are in contact with each other is maintained as described above, it is not necessary to use a clamping jig for bringing the end portion 2*e* of the wire and the joining pieces 81*a* and 81*b* into contact with each other when such welding or attaching under pressure is performed.

On the other end side of each terminal fitting 8, what is provided is a through hole 82*h* into which a coupling member such as a bolt for establishing connection to an external apparatus such as a power supply is fitted. Here, in the state where the terminal fitting 8 is fixed to the side wall portion 41, the other end side region provided with the through hole 82*h* is disposed so as to project from the side wall portion 41 (FIG. 1). In addition, it is also possible to employ the mode in which the other end side region having the through hole 82*h* is also supported by the material of the side wall portion 41. For example, in the case where the side wall portion 41 is made of an insulating material, which will be described later, a support base (not shown) of the other end side region can be integrally molded with the material. By arranging a nut or the like in the support base as appropriate, and disposing the through hole 82*h* coaxially to the hole of the nut, it becomes possible to fit the coupling member such as a bolt to thereby establish a connection with the external apparatus.

Figure 3:
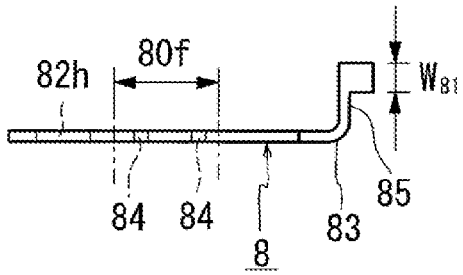
FIG. 3 shows terminal fittings included in the reactor according to the embodiment.
Figure 3:
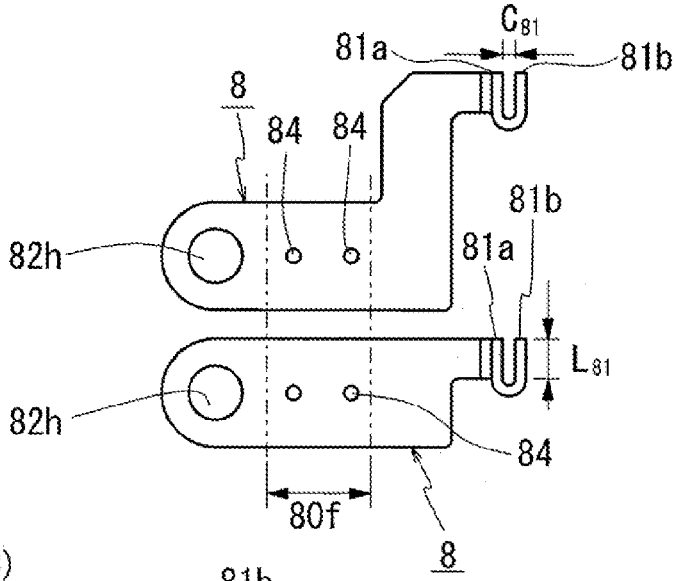
Figure 3:
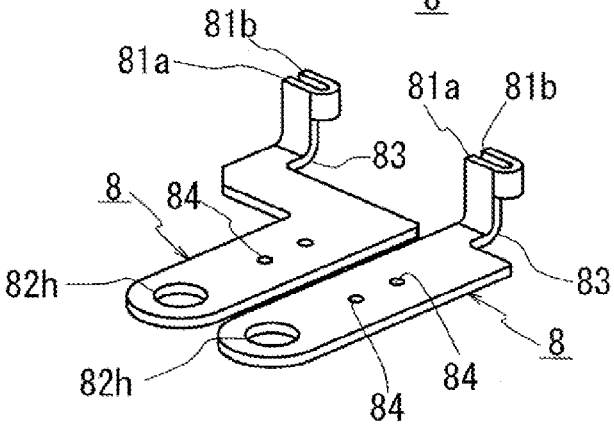

The shape of the terminal fittings 8 shown in FIG. 3 is merely an example, and changes can be made as appropriate so long as each terminal fitting 8 includes at least a plurality of joining pieces, a connection portion to the external apparatus, and a fixation portion for the side wall portion 41.

The terminal block 410 to which the terminal fittings 8 having the particular shape described above are fixed is, as shown in FIG. 2, provided with concave grooves 410*c* where the fixation regions 80*f* of the terminal fittings 8 are respectively disposed. The concave grooves 410*c* are provided with positioning projections 410*p* for positioning the terminal fittings 8, and the terminal fittings 8 are provided with positioning holes 84 to which the projections 410*p* are fitted. The shape, number of pieces, disposition position of the positioning projections 410*p* and the positioning holes 84 are not particularly limited, so long as they are capable of positioning the terminal fittings 8. It is possible to employ the mode including no positioning projections 410*p* and positioning holes 84. Alternatively, the terminal fittings may be provided with the projections while the terminal block is provided with the holes.

The terminal fitting 8 fitted into the concave grooves 410*c* has its top portion covered by a terminal fixing member 9. The terminal fixing member 9 is fixed to the terminal block 410 by being tightened by bolts 91. As the material of the terminal fixing member 9, an insulating material such as an insulating resin used as the material of the case, which will be described later, can suitably be used.

Figure 5:
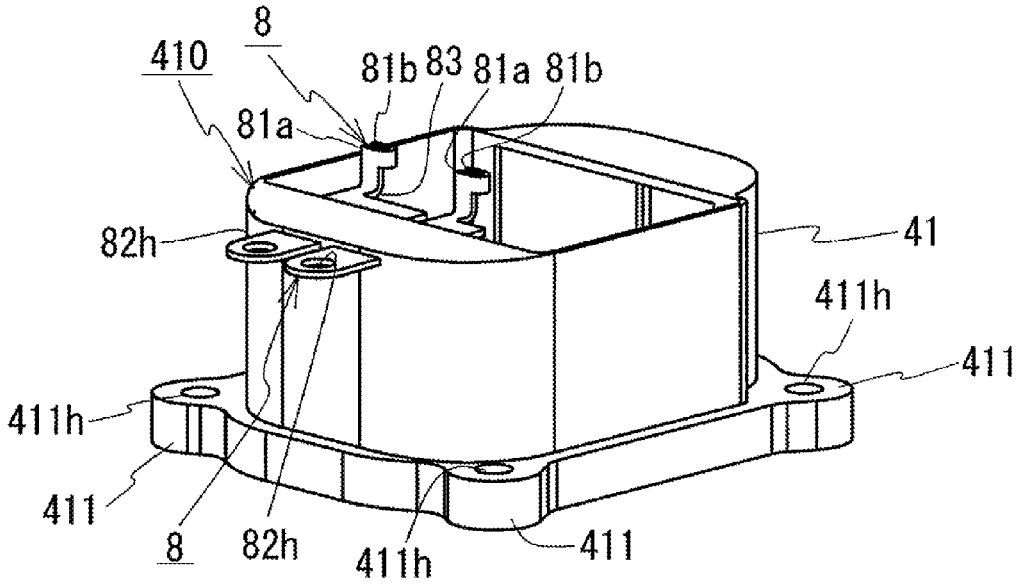
FIG. 5 is a schematic perspective view showing another mode of a side wall portion provided with the terminal fittings.

In the case where the side wall portion 41 is formed with an insulating material, which will be described later, it is also possible to form the terminal fitting 8 through insert molding as shown in FIG. 5 in place of using the terminal fixing member 9 and the bolts 91, such that the side wall portion 41, the terminal fitting 8, and the terminal block 410 are integrated.

Note that, it is also possible to form a molded product, which is obtained by previously covering the fixation regions 80*f* of the terminal fittings 8 by the insulating material, and to fix the formed product to the side wall portion 41.

(Material)

The material of the case 4 may be, for example, a metal material. Since the metal material is generally high in thermal conductivity, a case possessing an excellent heat dissipating characteristic can be obtained. Specific metal may include, for example, aluminum and aluminum alloy, magnesium (thermal conductivity: 156 W/m·K) and magnesium alloy, copper (390 W/m·K) and copper alloy, silver (427 W/m·K) and silver alloy, iron, austenitic stainless steel (e.g., SUS304: 16.7 W/m·K) and the like. Use of such aluminum, magnesium, and alloy thereof provides a lightweight case. Thus, it becomes possible to contribute toward reducing the weight of the reactor. In particular, since aluminum and aluminum alloy exhibit excellent corrosion resistance also, they can be suitably used for in-vehicle components. In the case where the case 4 is formed with any metal material, it can be achieved by casting such as die casting, and plastic working such as press working.

Alternatively, the material of the case 4 may be a non-metallic material such as resin, e.g., polybutylene terephthalate (PBT) resin, urethane resin, polyphenylene sulfide (PPS) resin, acrylonitrile butadiene styrene (ABS) resin or the like. Since such non-metallic materials generally possess an excellent electrical insulating characteristic, the insulation between the coil 2 and the case 4 can be enhanced. Further, since these non-metallic materials are lighter than the metal materials noted above, a reduction in weight of the reactor 1 can be achieved. Employing the mode in which filler made of ceramic, which will be described later, is added to the resin noted above, the heat dissipating characteristic can be improved. In the case where the case 4 is formed by resin, injection molding can suitably be used.

The material of the bottom plate portion 40 and that of the side wall portion 41 can be of the similar type. In this case, the bottom plate portion 40 and the side wall portion 41 become equivalent in thermal conductivity. Alternatively, since the bottom plate portion 40 and the side wall portion 41 are structured as separate members, they may be made of different materials. In this case, particularly, by selecting the materials such that the bottom plate portion 40 becomes greater in thermal conductivity than the side wall portion 41, heat from the coil 2 and the magnetic core 3 disposed on the bottom plate portion 40 can efficiently be dissipated to the fixation target such as a cooling base. Here, the bottom plate portion 40 is made of aluminum, while the side wall portion 41 is made of PBT resin. In the case where the bottom plate portion 40 is made of an electrically conductive material, by subjecting the bottom plate portion 40 to alumite treatment or the like to provide a very thin insulating coating (thickness: approx. 1 μm to 10 μm) on its surface, insulation can be enhanced.

(Coupling Method)

In the scheme of integrally connecting the bottom plate portion 40 and the side wall portion 41 to each other, various fixation members can be used. The fixation members may include, for example, tightening members such as an adhesive agent and bolts. Here, the bottom plate portion 40 and the side wall portion 41 are provided with bolt holes (not shown), and bolts (not shown) are employed as the fixation members. By screwing the bolts, the bottom plate portion 40 and the side wall portion 41 are integrated.

[Joining Layer]

The bottom plate portion 40 is provided with the joining layer 42 at a portion being brought into contact with at least the coil installation face of the coil 2. Here, the joining layer 42 is large enough to be brought into contact with the core installation face of the outer core portion 32. The joining layer 42 preferably has a multilayer structure, i.e., including an adhesive layer made of an insulating material on the front surface side that is brought into contact with the coil installation face or the core installation face, and a heat dissipation layer made of a material possessing excellent thermal conductivity on the side being brought into contact with the bottom plate portion 40.

The adhesive layer can be made of an insulating adhesive agent, for example. Specific examples are an epoxy base adhesive agent, an acryl base adhesive agent and the like. Here, the adhesive layer is a single-layer structure made of an insulating adhesive agent having a thickness of 0.6 mm. The adhesive layer is pressed and stretched by the core and the coil.

The heat dissipation layer is made of a material whose thermal conductivity is higher than 2 W/m·K. Preferably, the thermal conductivity of the heat dissipation layer is as high as possible, i.e., preferably 3 W/m·K or more, particularly preferably 10 W/m·K or more, and still more preferably 20 W/m·K or more, and even more preferably 30 W/m·K or more.

The specific material of the heat dissipation layer may include, for example, a metal material. Though the metal material is generally high in thermal conductivity, it is electrically conductive. Therefore, it is desired to enhance the insulation of the adhesive layer. Further, the heat dissipation layer made of a metal material tends to be heavy. In contrast thereto, use of a non-metallic inorganic material such as ceramic being one type of material selected from oxide, carbide, and nitride of metallic elements, B, and Si as the material of the heat dissipation layer is preferable, because an excellent heat dissipating characteristic and also an excellent electrical insulating characteristic are obtained.

More specific ceramic may be, silicon nitride ($Si_3N_4$): approx. 20 W/m·K to 150 W/m·K; alumina ($Al_2O_3$): approx. 20 W/m·K to 30 W/m·K, aluminum nitride (AlN): approx. 200 W/m·K to 250 W/m·K; boron nitride (BN): approx. 50 W/m·K to 65 W/m·K; and silicon carbide (SiC): approx. 50 W/m·K to 130 W/m·K. In the case where the heat dissipation layer is formed by these types of ceramic, for example, deposition such as PVD or CVD can be used. Alternatively, the heat dissipation layer can be formed by preparing a sintered plate of the ceramic noted above, and bonding the same to the bottom plate portion 40 by any appropriate adhesive agent.

Alternatively, the material of the heat dissipation layer may be an insulating resin containing a filler made of the ceramic noted above. The insulating resin may include, for example, epoxy resin, acrylic resin and the like. Since the insulating resin contains the filler possessing the excellent heat dissipating characteristic and the electrical insulating characteristic, the heat dissipation layer possessing the excellent heat dissipating characteristic and the electrical insulating characteristic can be structured. Further, in the case where resin containing a filler is used also, by applying the resin to the bottom plate portion 40 or the like, the heat dissipation layer can easily be formed. In the case where the heat dissipation layer is made of an insulating resin, particularly, use of an adhesive agent is preferable because excellent adhesion between the heat dissipation layer and the adhesive layer is achieved. Accordingly, the joining layer including the heat dissipation layer can strongly join the coil 2 and the bottom plate portion 40 to each other. In the case where the heat dissipation layer is formed with the insulating resin, for example, it can be formed with ease through use of screen printing. The screen printing can be applied also to the adhesive layer.

Here, the heat dissipation layer is formed with an epoxy base adhesive agent containing a filler made of alumina (thermal conductivity: 3 W/m·K). Further, here, the heat dissipation layer is formed as a two-layer structure of the adhesive agent, in which the thickness per layer is 0.2 mm, 0.4 mm in total (total thickness inclusive of the adhesive layer: 0.5 mm). The heat dissipation layer may be structured to include three or more layers. In the case where such a multilayer structure is employed, the material of at least one layer may be different from that of the other layers. For example, the heat dissipation layer may have a multilayer structure made up of materials differing in thermal conductivity from one another.

The shape of the joining layer 42 is not particularly limited so long as it has the area with which the coil installation face can be fully brought into contact. Here, as shown in FIG. 2, the joining layer 42 is in the shape conforming to the shape formed by the coil installation face of the coil 2 and the core installation face of the outer core portion 32. Thus, both the coil installation face and the core installation face can fully be brought into contact with the joining layer 42.

[Sealing Resin]

It is possible to employ the mode in which the case 4 is filled with a sealing resin (not shown) being an insulating resin. In this case, the end portions 2*e* of the wire are drawn outside the case 4, to be exposed outside the sealing resin, such that the end portions 2*e* of the wire and the terminal fittings 8 can be joined to each other through welding, soldering or the like. Alternatively, depending on the shape of the side wall portion 41, the sealing resin may be packed after such welding or the like is performed, to bury the end portions 2*e* of the wire and the terminal fittings 8.

The exemplary sealing resin may be epoxy resin, urethane resin, silicone resin and the like. Further, allowing the sealing resin to contain the filler possessing an excellent insulating characteristic and thermal conductivity, for example, the filler made of at least one type of ceramic selected from silicon nitride, alumina, aluminum nitride, boron nitride, mullite, and silicon carbide, the heat dissipating characteristic can further be enhanced.

In the case where the case 4 is filled with a sealing resin, a gasket 6 may be provided in order to prevent uncured resin from leaking from the clearance between the bottom plate portion 40 and the side wall portion 41. Here, the gasket 6 is an annular element of the dimension with which the gasket 6 can be fitted to the outer circumference of the combined product 10 made up of the coil 2 and the magnetic core 3. Though the gasket 6 made of synthetic rubber is employed, the gasket made of any appropriate material can be used. On the installation side of the side wall portion 41 of the case 4, a gasket groove (not shown) in which the gasket 6 is disposed is provided.

<<Manufacture of Reactor>>

The reactor 1 structured as described above can be representatively manufactured as follows: preparing the combined product; preparing the side wall portion; and preparing the bottom plate portion→fixing the coil→disposing the side wall portion→assembling the case→joining the terminal fittings and the wire to each other→packing the sealing resin.

[Preparing Combined Product]

Firstly, a description will be given of the production procedure of the combined product 10 made up of the coil 2 and the magnetic core 3. Specifically, as shown in FIG. 4, the inner core portions 31 are formed by laminating the core pieces

31*m* and the gap members 31*g*. In the state where the surrounding wall portion 51 (divided pieces 511 and 512) of the insulator 5 is disposed at the outer circumference of the inner core portions 31, the inner core portions 31 are respectively inserted into the coil elements 2*a* and 2*b*. Since the cross section of the surrounding wall portion 51 is ]-shaped, it can easily be disposed on the installation side of the inner core portion 31 and the face opposing thereto. The combined product 10 is formed by disposing the frame-like portions 52 and the outer core portions 32 to the coil 2, such that the end faces of the coil elements 2*a* and 2*b* and the end faces 31*e* of the inner core portions 31 are interposed between the frame-like portions 52 of the insulator 5 and the inner end faces 32*e* of the outer core portions 32. At this time, the end faces 31*e* of the inner core portions 31 are exposed outside the opening portions of the frame-like portions 52 and are brought into contact with the inner end faces 32*e* of the outer core portions 32. In forming the combined product 10, the sleeve-like portions of the frame-like portions 52 can be used as a guide.

Though the pair of divided pieces 511 and 512 structuring the surrounding wall portion 51 are not structured to engage with each other, since the pair of divided pieces 511 and 512 are inserted together with the inner core portions 31 into the coil elements 2*a* and 2*b*, and then the outer core portion 32 is disposed, the state where the pair of divided pieces 511 and 512 are disposed between the inner circumferential face of the coil elements 2*a* and 2*b* and the inner core portions 31 is maintained. Therefore, the pair of divided pieces 511 and 512 will not come off.

[Preparing Side Wall Portion]

Meanwhile, at the concave grooves 410*c* of the side wall portion 41 structured in a prescribed shape through injection molding or the like, the terminal fittings 8 and the terminal fixing member 9 are disposed in order. Then, the bolts 91 are tightened to prepare the side wall portion 41 to which the terminal fittings 8 are fixed. It is also possible to prepare a molded product in which the terminal fittings 8 and the side wall portion 41 are integrated, as described above (FIG. 5).

[Preparing Bottom Plate Portion, Fixing Coil]

Figure 2:
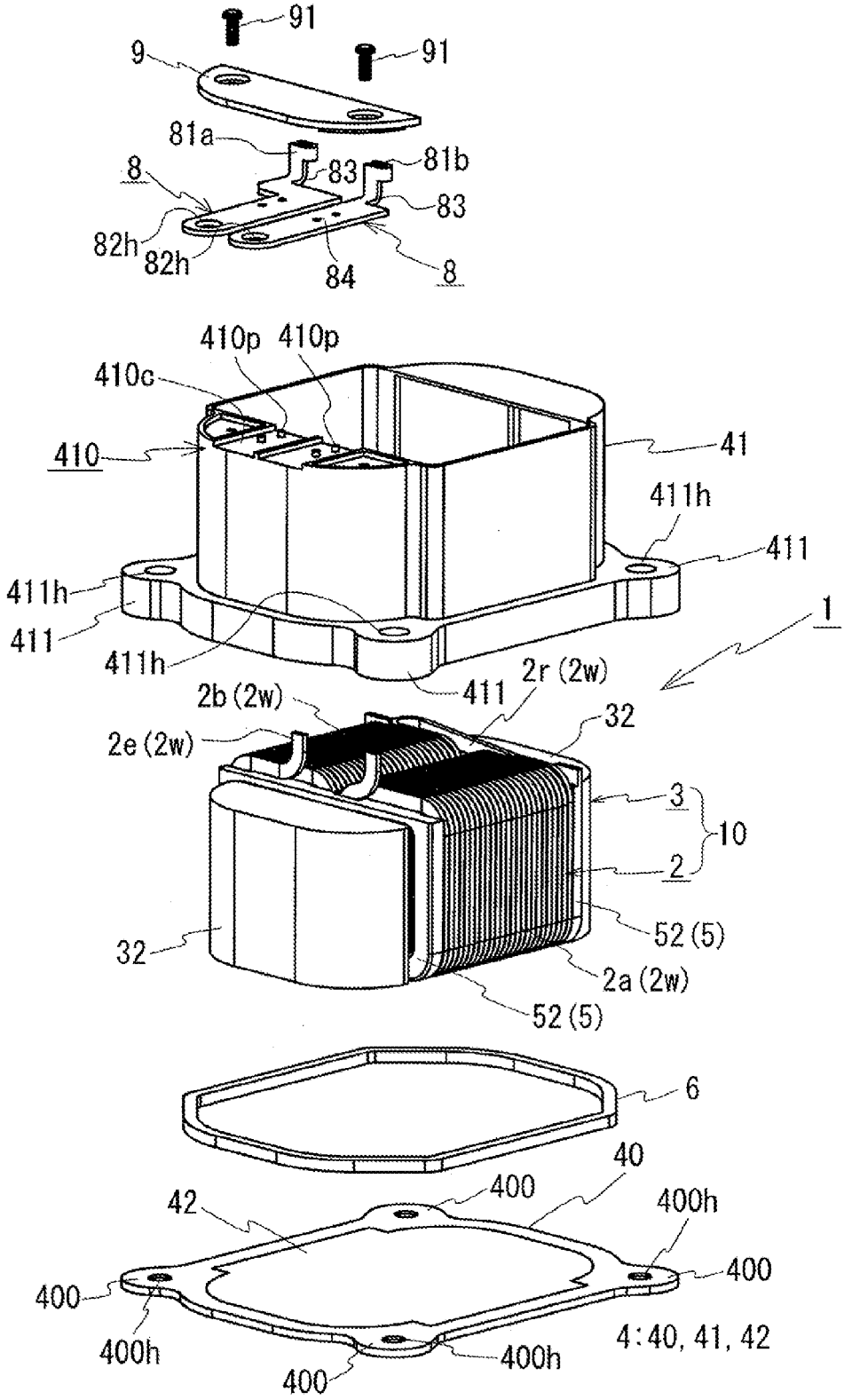
FIG. 2 is an exploded perspective view schematically showing the reactor according to the embodiment.

On the other hand, as shown in FIG. 2, an aluminum plate is punched out into a prescribed shape to form the bottom plate portion 40. On one surface, the joining layer 42 of a prescribed shape is formed by screen printing, to prepare the bottom plate portion 40 provided with the joining layer 42 including the heat dissipation layer. Then, on the joining layer 42, the assembled combined product 10 is placed. Thereafter, the joining layer 42 is cured to fix the combined product 10 to the bottom plate portion 40.

The joining layer 42 causes the coil 2 to be closely in contact with the bottom plate portion 40. Further, the position of the coil 2 and that of the outer core portion 32 are fixed, whereby the position of the inner core portions 31 interposed between a pair of outer core portions 32 is fixed. That is, without the necessity of separately using an adhesive agent for joining the core pieces 31*m* and the gap members 31*g*, the joining layer 42 integrates the magnetic core 3 including the inner core portions 31 and the outer core portions 32. Further, since the joining layer 42 is made of the adhesive agent, the combined product 10 is strongly fixed to the joining layer 42.

Though the joining layer 42 may be formed immediately before the combined product 10 is disposed, it is also possible to use the bottom plate portion 40 at which the joining layer 42 has been previously formed. In the latter case, it is preferable to dispose release paper before disposition of the combined product 10, such that no foreign object attaches to the joining layer 42. It is also possible to previously form solely the heat dissipation layer, and to form solely the adhesive layer immediately before disposition of the combined product 10.

Note that, in forming the combined product 10, an adhesive agent can be used for joining the core pieces 31*m* and the gap members 31*g*. In this case, for example, the core pieces 31*m* and the gap members 31*g* to which the adhesive agent is applied are stacked, to assemble the inner core portions 31. Thereafter, as described above, the surrounding wall portion 51 and the coil 2 are disposed. The frame-like portions 52 are disposed between the coil 2 and the outer core portions 32 as described above. The end faces 31*e* of the inner core portions 31 to which the adhesive agent is applied and the inner end face 32*e* of the outer core portion 32 are brought into contact with each other. Then, the adhesive agent is cured, to form the combined product 10. In this mode, the inner core portions 31 and the combined product 10 can be handled with ease. By bringing such a combined product 10 into contact with the joining layer 42, the combined product 10 (particularly the coil 2) can be strongly fixed to the joining layer 42, similarly to the manner in which no adhesive agent is used.

[Disposing Side Wall Portion]

The side wall portion 41 where the terminal fittings 8 are fixed is allowed to cover the from above the combined product 10 so as to surround the outer circumferential face of the combined product 10. Thus, the side wall portion 41 is disposed on the bottom plate portion 40. At this time, the side wall portion 41 is disposed such that the end portions 2*e* of the wire strike the curve portion 83, which serves as the guide portion of the terminal fittings 8. The end portions 2*e* of the wire striking the guide portion are guided along the curvature toward the joining pieces 81*a* and 81*b*. Then, ultimately the end portions 2*e* of the wire can be automatically inserted between the joining pieces 81*a* and 81*b*, to be interposed in the space formed by the joining pieces 81*a* and 81*b*. Here, since each end portion 2*e* of the wire is inserted between the joining pieces 81*a* and 81*b* as described above, the front and back surfaces of the end portion 2*e* of the wire are brought into contact with the joining pieces 81*a* and 81*b*.

[Assembling Case]

In the state where each end portion 2*e* of the wire is interposed between the joining pieces 81*a* and 81*b*, the bottom plate portion 40 and the side wall portion 41 are integrated by the separately prepared bolts (not shown). At this time, by adjusting the position of the side wall portion 41, the position of the joining pieces 81*a* and 81*b* can also be adjusted. Accordingly, by adjusting the position of the joining pieces 81*a* and 81*b*, it becomes possible to bring the end portion 2*e* of the wire into contact under pressure with at least one of the joining pieces 81*a* and 81*b*. When the bolts are tightened in this pressurized contact state, the contact between the joining pieces 81*a* and 81*b* and the end portion 2*e* of the wire can more surely be secured. Alternatively, it is also possible to allow the joining pieces 81*a* and 81*b* to be in contact under pressure with the end portion 2*e* of the wire, by caulking the joining pieces 81*a* and 81*b* in the state where the end portion 2*e* of the wire is interposed between the joining pieces 81*a* and 81*b*. Alternatively, the end portion 2*e* of the wire may not be in contact with the joining pieces 81*a* and 81*b* but may be still interposed in the space formed by the joining pieces 81*a* and 81*b*.

Note that, when the side wall portion 41 is covered over the combined product 10 from above as described above, one trapezoidal faces of the outer core portions 32 of the combined product 10 are covered by the terminal block 410 of the side wall portion 41 and the overhanging portion described above, to be stopped thereby. That is, the terminal block 410 and the overhanging portion function to position the side wall portion 41 relative to the combined product 10. In addition, the terminal block 410 or the overhanging portion can prevent the combined product 10 from coming off from the side wall portion 41 when the reactor 1 is disposed such that the bottom plate portion 40 is disposed face up or sideways. It is also possible to separately provide a position fixing portion or the like for preventing the outer core portion 32 from coming off, on the inner side of the terminal block 410 or the overhanging portion.

Through the process described above, the box-like case 4 as shown in FIG. 1 is assembled, and the combined product 10 can be stored in the case 4. Further, the state where each end portion 2*e* of the wire is interposed between the pair of joining pieces 81*a* and 81*b* can be achieved.

[Joining Terminal Fitting and Wire]

Each end portion 2*e* of the wire and at least one of the joining pieces 81*a* and 81*b* of the terminal fitting 8 are joined to each other through welding or soldering, to establish an electrical connection between them. In the present embodiment, the end portion 2*e* of the wire is maintained to be interposed between the pair of joining pieces 81*a* and 81*b* and to be in contact with at least one of the joining pieces 81*a* and 81*b*. Accordingly, in joining, no jig for bringing the joining pieces 81*a* and 81*b* and the end portion 2*e* of the wire in contact with each other is required. Alternatively, an electrical connection can be established between the joining pieces 81*a* and 81*b* and the end portion 2*e* of the wire via solder, by packing the solder between them. Accordingly, in this connecting manner also, such a jig is not required. Through this process, the reactor 1 including no sealing resin can be formed.

[Packing Sealing Resin]

Meanwhile, allowing the case 4 to be filled with a sealing resin (not shown) and allowing the resin to be cured, the reactor 1 provided with the sealing resin is formed. In this mode, the joining pieces 81*a* and 81*b* and the end portion 2*e* of the wire may be joined after the case is filled with the sealing resin.

<<Application>>

The reactor 1 structured as described above is suitably used for applications in which the energizing conditions are, for example: the maximum current (direct current) is approx. 100 A to 1000 A; the average voltage is approx. 100 V to 1000 V; and the working frequency is approx. 5 kHz to 100 kHz. Representatively, the reactor 1 is suitably used as a constituent component of an in-vehicle power converter apparatus such as an electric vehicle or a hybrid vehicle.

<<Effect>>

Since the reactor 1 structured as described above has the joining layer 42 including the heat dissipation layer, which exhibits excellent thermal conductivity being higher than 2 W/m·K, interposed between the bottom plate portion 40 and the coil 2, the heat of the coil 2 and that of the magnetic core 3 generated during operation can be efficiently dissipated to the fixation target such as a cooling base via the heat dissipation layer. Accordingly, the reactor 1 possesses an excellent heat dissipating characteristic. Structuring the entire joining layer 42 with an insulating material whose thermal conductivity is higher than 2 W/m·K, the reactor possessing a further excellent heat dissipating characteristic can be obtained.

In particular, in connection with the reactor 1, the bottom plate portion 40 is made of a material exhibiting excellent thermal conductivity such as aluminum. This also contributes toward dissipating heat from the coil 2 to the fixation target in an efficient manner. Thus, the excellent heat dissipating characteristic can be obtained. Further, in connection with the reactor 1, though the bottom plate portion 40 is made of a metal material (electrically conductive material), since at least one side of the joining layer 42 being in contact with the coil 2 is made of an insulating material, the insulation between the coil 2 and the bottom plate portion 40 can be secured even when the joining layer 42 is extremely thin, e.g., measuring approximately 0.1 mm. In particular, in the present embodiment, since the entire joining layer 42 is made of an insulating material, the coil 2 and the bottom plate portion 40 can be fully insulated from each other. Further, thanks also to the small thickness of the joining layer 42, heat from the coil 2 and the like can be easily transferred to the fixation target via the bottom plate portion 40. Thus, the reactor 1 possesses an excellent heat dissipating characteristic. Further, in the present embodiment, since the entire joining layer 42 is structured with an insulating adhesive agent, excellent adhesion between the coil 2 and the magnetic core 3 and the joining layer 42 can be obtained. This also facilitates transfer of heat from the coil 2 and the like to the joining layer 42. Thus, the reactor 1 possesses an excellent heat dissipating characteristic. Further, in the present embodiment, use of a coated rectangular wire as the wire 2*w* makes it possible to bring the substantially entire side face portion of the turns structuring the coil installation face into contact with the joining layer 42, and to obtain a wide contact area between the coil 2 and the joining layer 42. From this viewpoint also, the reactor 1 has an excellent heat dissipating characteristic.

Further, in connection with the reactor 1, when the side wall portion 41 to which the terminal fittings 8 each including a pair of joining pieces 81*a* and 81*b* is disposed at the bottom plate portion 40, allowing the end portion 2*e* of the wire to be inserted between the joining pieces 81*a* and 81*b*, the end portion 2*e* of the wire can be interposed in the space formed by the joining pieces 81*a* and 81*b*. In particular, in the present embodiment, allowing the curve portion 83 to function as the guide portion, the end portion 2*e* of the wire can be inserted between the joining pieces 81*a* and 81*b* with ease, and furthermore, at least one of the joining pieces 81*a* and 81*b* and the end portion 2*e* of the wire can be automatically brought into contact with each other. Further, as described above, in connection with the terminal fittings 8, the joining pieces 81*a* and 81*b* and the end portion 2*e* of the wire can be brought into contact under pressure with each other by: adjusting the bending angle formed between the one end side region to which the end portion 2*e* of the wire is connected and the fixation region 80*f*, the magnitude of the curvature of the curve portion 83, and the interval $C_{81}$ between the joining pieces 81*a* and 81*b*; adjusting the position of the side wall portion 41 in fixing the side wall portion 41 and the bottom plate portion 40; or caulking the joining pieces 81*a* and 81*b*. In this manner, in connection with the reactor 1, at least one of the joining pieces 81*a* and 81*b* and the end portion 2*e* of the wire can be in contact with each other. Furthermore, this contact state can be maintained. Therefore, in joining the joining pieces 81*a* and 81*b* and the end portion 2*e* of the wire through welding, soldering or the like, it is not necessary to prepare a jig for maintaining the contact state of at least one of the joining pieces 81*a* and 81*b* and the end portion 2*e* of the wire. Thus, the reactor 1 exhibits excellent attachment workability of the terminal fittings.

Further, since the reactor 1 includes the case 4, the combined product 10 can be protected from the environment, and can be mechanically protected. Further, despite provision of the case 4, the reactor 1 is lightweight because the side wall portion 41 is made of resin. Even more, the reactor 1 is small in size because the interval between the outer circumferential face of the coil 2 and the inner circumferential face of the side wall portion 41 can be reduced, as compared to the case where the side wall portion made of an electrically conductive material is used. Further, thanks also to the thin joining layer 42 as described above, the interval between the coil installation face of the coil 2 and the inner face of the bottom plate portion 40 can be reduced, and hence the reactor 1 is small in size.

In addition, the reactor 1 is made up of the independent separate members, i.e., the bottom plate portion 40 and the side wall portion 41, which are combined and integrated by the fixation members. Therefore, the joining layer 42 can be formed at the bottom plate portion 40 in the state where the side wall portion 41 is removed. Accordingly, the joining layer 42 can be formed with ease, and hence the reactor 1 is excellent in productivity. Further, since the bottom plate portion 40 and the side wall portion 41 are the separate members, they can be made of different materials, and hence the materials of the case 4 can be selected from a wider range. In addition, since the reactor 1 is provided with the insulator 5, insulation between the coil 2 and the magnetic core 3 can be enhanced.

{Variation 1}

Though the description has been given of the mode in which the bottom plate portion and the side wall portion are made of different materials in the embodiment described above, the mode in which the bottom plate portion and the side wall portion are made of the identical material can be employed. For example, when the bottom plate portion and the side wall portion are made of a metal material possessing an excellent heat dissipating characteristic such as aluminum, magnesium, the alloy thereof, the heat dissipating characteristic of the reactor can further be enhanced. In particular, in this mode, when a sealing resin is provided, the heat from the coil and the magnetic core can be efficiently transferred to the case. Furthermore, use of an insulating resin as the sealing resin can enhance insulation between the outer circumferential face of the coil and the inner face of the side wall portion. In this mode also, provision of the adhesive layer made of an insulating adhesive agent can secure insulation between the coil installation face of the coil and the bottom plate portion. Furthermore, provision of the heat dissipation layer made of a material whose thermal conductivity is higher than 2 W/m·K can narrow the interval between the coil installation face and the inner face of the bottom plate portion, and hence a reduction in size is achieved. Note that, in this mode, an interval for securing insulation between the outer circumferential face of the coil and the inner face of the side wall portion is provided. Further, in order to insulate the terminal fittings 8 and the side wall portion from each other, for example, an insulating coat may be provided on the surface of the terminal fittings 8 except for the surrounding of the joining pieces 81*a* and 81*b* and the through holes 82*h*.

{Variation 2}

Though the description has been given of the mode in which the heat dissipation layer is made of an insulating adhesive agent in the embodiment described above, the mode in which the heat dissipation layer is made of ceramic such as aluminum nitride, alumina or the like can be employed. In the case where the heat dissipation layer made of ceramic is provided, provision of the separate adhesive layer as in the embodiment described above makes it possible to bring the coil and the heat dissipation layer into close contact with each other.

{Variation 3}

In the embodiment described above, the description has been given of the mode in which the surrounding wall portion 51 of the insulator 5 is structured by a pair of divided pieces 511 and 512. Alternatively, as an insulator 5α shown in FIG. 6, the surrounding wall portion 51α may be a single sleeve-like element. Here, the insulator 5α will be detailed. The other structures are similar to those in the embodiment described in the foregoing and hence the description thereof will not be repeated.

The insulator 5α includes a pair of sleeve-like surrounding wall portions 51α in which the inner core portions 31 of the magnetic core 3 are stored, and a pair of frame-like portions 52α being in contact with the inner core portions 31 and the outer core portions 32. Each surrounding wall portion 51α is a square sleeve-like element that conforms to the outer shape of the corresponding inner core portion 31. The opposite end portions of the surrounding wall portion 51α each have a concave and convex shape, i.e., fitting concave and convex portion 510. Similarly to the frame-like portion 52 according to the embodiment, each frame-like portion 52α is provided with, at its flat plate-like body portion, a pair of opening portions into which the inner core portions 31 are respectively inserted. In connection with each opening portion, on the side being brought into contact with the surrounding wall portion 51α, a plurality of convex pieces are provided, which are in a concave and convex shape corresponding to the concave and convex of the surrounding wall portion 51α. The concave and convex form a fitting concave and convex portion 520. By the fitting concave and convex portion 510 of each end portion of the surrounding wall portion 51α being fitted to the fitting concave and convex portion 520 of the frame-like portion 52α, the surrounding wall portion 51α and the frame-like portion 52α are integrated, and positional relationship between them is maintained. Further, in connection with the frame-like portion 52α, on the side being brought into contact with the outer core portion 32, a 1-shaped frame portion 521 for positioning the outer core portion 32 is provided. Similarly to the insulator 5 according to the embodiment, part of the frame portion 521 functions as the pedestal.

Assembly of the combined product using the insulator 5*a* described above is carried out in the following manner. Firstly, in the state where the inner end face of one outer core portion 32 is oriented upward in FIG. 6, the outer core portion 32 is placed. From the opening side of the frame portion 521, one frame-like portion 52α is slid such that the frame portion 521 is fitted to the outer core portion 32. Through this step, relative to the one frame-like portion 52α, the one outer core portion 32 is positioned.

Next, the fitting concave and convex portion 510 of the surrounding wall portion 51α is fitted to the fitting concave and convex portion 520 of the one frame-like portion 52α, to attach the pair of surrounding wall portions 51α to the frame-like portion 52α. Through this step, the positional relationship of one frame-like portion 52α and the surrounding wall portion 51α is maintained.

Next, the core pieces 31*m* and the gap members 31*g* are alternately inserted into the surrounding wall portions 51α and stacked therein. The stacked inner core portions 31 have its stacked state retained by the surrounding wall portions 51α. Here, since the surrounding wall portions 51α are in the shape provided with slits opening upward, at a pair of side face portions thereof, the core pieces 31*m* can be held by fingers or the like when the core pieces 31*m* and the gap members 31*g* are inserted into the surrounding wall portions 51α. Hence, the insertion work can safely and easily be carried out.

Figure 6:
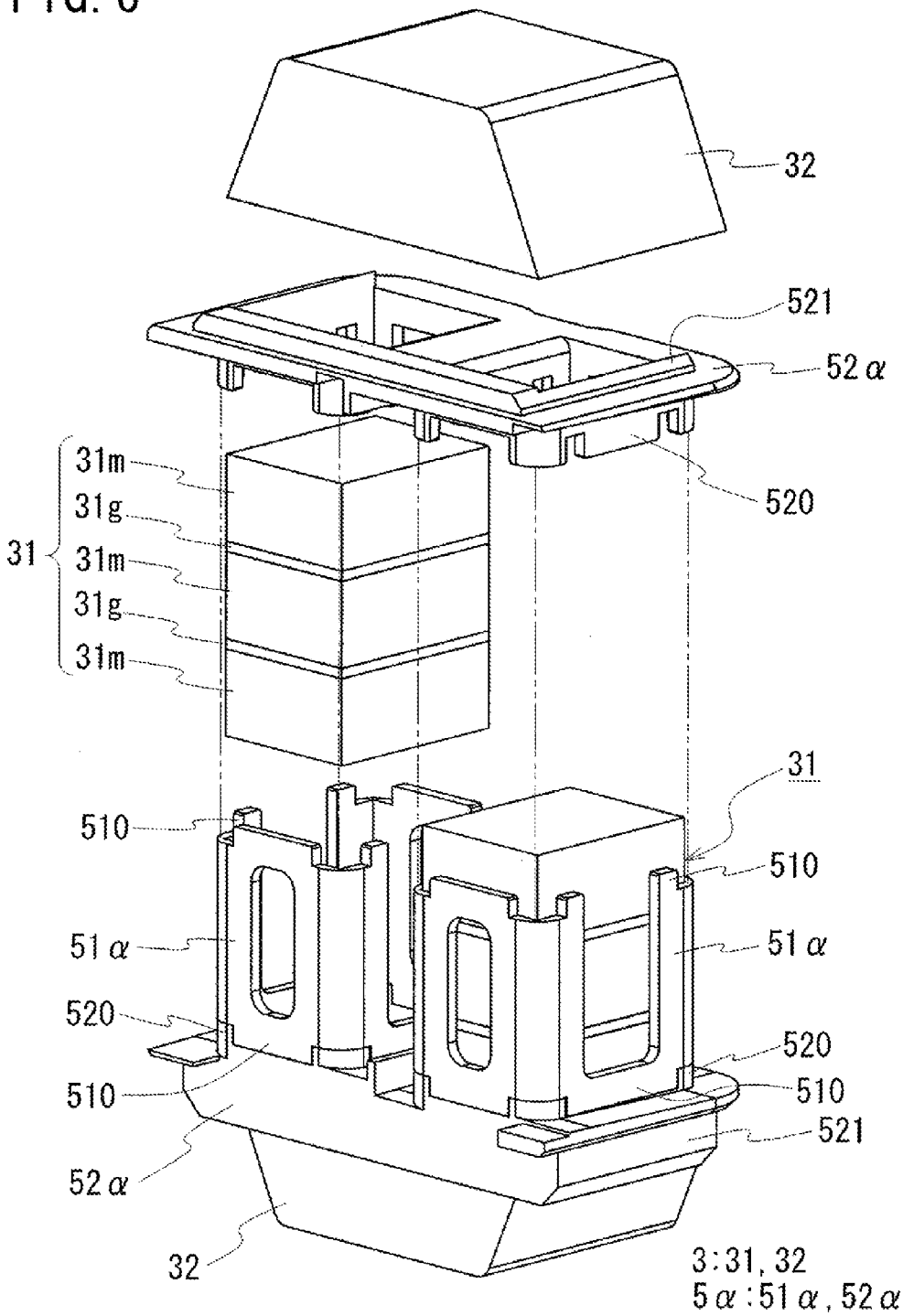
FIG. 6 is an exploded perspective view showing still another mode of the combined product made up of the coil and the magnetic core.

Next, the coil elements are attached to the outer circumference of the surrounding wall portions 51α, with the coil couple portion side of the coil (not shown) oriented downward in FIG. 6. Then, other frame-like portion 52α is attached to the surrounding wall portions 51α, and other outer core portion 32 is attached to the other frame-like portion 52α in the similar manner as described above. Through this step, the positional relationship between the surrounding wall portions 51α and the other frame-like portion 52α is retained, and the other outer core portion 32 is positioned relative to the other frame-like portion 52α. Through the foregoing steps, the combined product made up of the coil and the magnetic core 3 is obtained.

The one trapezoidal face of each of the outer core portions 32 is disposed so as to be brought into contact with the joining layer of the bottom plate portion, such that the combined product falls from the state shown in FIG. 6 toward the depth side of the drawing.

Similarly to the embodiment having been described above, use of the insulator 5α can eliminate the necessity of using an adhesive agent in forming the magnetic core 3. In particular, the insulator 5α can easily maintain the integrated state achieved by engagement of the surrounding wall portions 51α and the frame-like portions 52α with each other. Therefore, the combined product can easily be handled in disposing the same at the bottom plate portion of the case and the like.

Further, employing the structure in which the back face of one outer core portion 32 is brought into contact with the side wall portion of the case, and a member (for example, a leaf spring) which presses other outer core portion 32 toward one outer core portion 32 is inserted between the back face of other outer core portion 32 and the side wall portion, it becomes possible to prevent the gap length from changing by any external factor such as vibrations or a shock. In such a mode in which the pressing member is used, when the gap members 31*g* are each an elastic gap member made of an elastic material such as silicone rubber, fluororubber and the like, deformation of the gap members 31*g* can adjust the gap length or absorb a certain amount of dimension error. The pressing members and the elastic gap members can be used in the embodiment and variations having been described above, and in the variation whose description will follow.

{Variation 4}

Alternatively, another mode in which no adhesive agent is used in forming the magnetic core 3 may be, for example, use of a band-like fastening member (not shown) that can retain the magnetic core in an annular manner. The band-like fastening member may be, for example, an element including a band portion disposed at the outer circumference of the magnetic core, and a lock portion attached to one end of the band portion to fix the loop formed by the band portion to a prescribed length. The lock portion may include an insertion hole into which the other end side region of the band portion having an elongated protrusion is inserted, and a tooth portion provided at the insertion hole to mesh with the elongated protrusion of the band portion. Thus, what is suitably used is the band-like fastening member in which a ratchet mechanism is structured by the elongated protrusion at the other end side region of the band portion and the tooth portion of the lock portion, so as to be capable of fixing the loop of the prescribed length.

The material of the band-like fastening member may be a material which is non-magnetic and heat resistant, e.g., capable of withstanding the temperature during operation of the reactor. For example, it may be a metal material such as stainless steel, a non-metallic material such as heat resistant polyamide resin, polyetheretherketone (PEEK) resin, polyethylene terephthalate (PET) resin, polytetrafluoroethylene (PTFE) resin, polyphenylene sulfide (PPS) resin or the like. Commercially available tying members, for example, Ty-Rap (registered trademark of Thomas & Betts International, Inc.), PEEK Tie (ties available from HellermannTyton Corporation), stainless steel bands (available from Panduit Corp.), may be used.

When the combined product is assembled, in connection with the band-like fastening member, the band portion is wrapped around, for example, in the following order: the outer circumference of one outer core portion; between the outer circumference of one inner core portion and the inner circumferential face of the coil element; the outer circumference of the other outer core portion; and between the outer circumference of the other inner core portion and the inner circumferential face of the coil element. Then, by fixing the loop length by the lock portion, the magnetic core can be fixed in an annular shape. Alternatively, after the combined product made up of the coil and the magnetic core is assembled as has been described in the embodiment and others described above, the band portion is disposed so as to wrap around the outer core portion and the outer circumference of the coil, and the loop length is fixed. Use of such a band-like fastening member makes it possible to integrate the magnetic core without use of an adhesive agent. Therefore, for example when the combined product is disposed at the bottom plate portion, the combined product can easily be handled. Further, the interval between the core pieces can easily be maintained.

Further, employing the structure in which a buffer member is interposed between the outer circumference of the magnetic core or between the outer circumference of the coil and the band-like fastening member, any damage that may be done by the tightening force of the band-like fastening member to the magnetic core and the coil can be suppressed. The material, thickness, number of pieces, disposition place of the buffer member can appropriately be selected such that the tightening force of the magnitude with which the annular magnetic core can retain the prescribed shape acts on the magnetic core. For example, a molded component having a thickness of approximately 0.5 to 2 mm obtained by molding resin such as ABS resin, PPS resin, PBT resin, or epoxy resin so as to conform to the shape of the core or the like, a rubber-like plate member such as silicone rubber or the like can be used as the buffer member.

Note that the embodiment having been described above can be changed as appropriate without departing from the gist of the present invention, and the present invention is not limited to the foregoing structure. For example, the shape and number of pieces of the joining pieces of the terminal fittings, the joining manner of a plurality of joining pieces can be changed as appropriate.

INDUSTRIAL APPLICABILITY

The reactor of the present invention can suitably be used as a constituent component of a power converter apparatus such as an in-vehicle converter installed in a vehicle such as a hybrid vehicle, an electric vehicle, a fuel cell vehicle and the like. The reactor manufacturing method of the present invention can be suitably used for manufacturing the reactor of the present invention. The reactor component of the present invention can be suitably used as the constituent component of the reactor of the present invention.

REFERENCE SIGNS LIST

1: REACTOR
10: COMBINED PRODUCT
2: COIL
2*a*, 2*b*: COIL ELEMENT
2*r*: COIL COUPLE PORTION

2*w*: WIRE
2*e*: END PORTION OF WIRE (POWER SUPPLY PORTION)
3: MAGNETIC CORE
31: INNER CORE PORTION
31*e*: END FACE
31*m*: CORE PIECE
31*g*: GAP MEMBER
32: OUTER CORE PORTION
32*e*: INNER END FACE
4: CASE
40: BOTTOM PLATE PORTION
41: SIDE WALL PORTION
42: JOINING LAYER
400, 411: ATTACHING PORTION
400*h*, 411*h*: BOLT HOLE
410: TERMINAL BLOCK
410*c*: CONCAVE GROOVE
410*p*: POSITIONING PROJECTION
5, 5*a*: INSULATOR
51, 51*a*: SURROUNDING WALL PORTION
510, 520: FITTING CONCAVE AND CONVEX PORTION
511, 512: DIVIDED PIECE
52, 52*a*: FRAME-LIKE PORTION
52*p*: PEDESTAL
521: FRAME PORTION
6: GASKET
8: TERMINAL FITTING
80*f*: FIXATION REGION
81*a*, 81*b*: JOINING PIECE
82*h*: THROUGH HOLE
83: CURVE PORTION
84: POSITIONING HOLE
85: FLAT PORTION
9: TERMINAL FIXING MEMBER
91: BOLT

The invention claimed is:

1. A reactor, comprising:

a combined product and a case storing the combined product, the combined product including a coil made of a wound wire and a magnetic core where the coil is disposed, wherein the case includes a bottom plate portion being brought into contact with a fixation target when the reactor is installed in the fixation target, a side wall portion that is independent of the bottom plate portion, that is integrated with the bottom plate portion by a fixation member, and that surrounds a periphery of the combined product, a joining layer that is formed at one face of the bottom plate portion to fix the coil to the bottom plate portion, and a terminal fitting that is fixed to the side wall portion, an end portion of the wire structuring the coil being electrically connected to the terminal fitting, wherein the terminal fitting has, on its one end side, a plurality of joining pieces that are disposed at positions opposing to the end portion of the wire, the end portion of the wire being interposed in a space formed by the joining pieces.

2. The reactor according to claim 1, wherein the end portion of the wire is in contact with at least one of the joining pieces.

3. The reactor according to claim 1, wherein the end portion of the wire and the at least one of the joining pieces are electrically connected to each other through one of welding and soldering.

4. The reactor according to claim 1, wherein the joining layer is disposed on a side being in contact with the coil, the joining layer having a multilayer structure including an adhesive layer structured with an insulating adhesive agent and a heat dissipation layer disposed on a side being in contact with the bottom plate portion, and the bottom plate portion is structured with an electrically conductive material.

5. The reactor according to claim 4, wherein at least part of the heat dissipation layer is structured with a material whose thermal conductivity is higher than 2 W/m·K.

6. The reactor according to claim 4, wherein the heat dissipation layer is structured with an epoxy base adhesive agent including an alumina filler, and the bottom plate portion is made of one of aluminum and aluminum alloy.

7. The reactor according to claim 1, wherein the side wall portion is structured with an insulating material.

8. The reactor according to claim 7, wherein the terminal fitting is integrally molded with the side wall portion.

9. The reactor according to claim 1, wherein the bottom plate portion is equal to or higher than the side wall portion in thermal conductivity.

10. The reactor according to claim 2, wherein the terminal fitting is formed with a plate member made of an electrically conductive material being bent, the reactor further comprising a guide portion provided between one end side region having the joining pieces and a fixation region being fixed to the side wall portion, the guide portion guiding the end portion of the wire such that at least one of the joining pieces and the end portion of the wire are brought into contact with each other.

11. A reactor component used as a case for storing a combined product including a coil made of a wound wire and a magnetic core where the coil is disposed, the case including a bottom plate portion and a side wall portion provided to stand upright from the bottom plate portion, the reactor component comprising:

a side wall portion that is disposed to surround a periphery of the combined product when the combined product is stored; and a terminal fitting that is fixed to the side wall portion, an end portion of the wire structuring the coil being electrically connected to the terminal fitting when the combined product is stored, wherein the side wall portion is independent of the bottom plate portion including a joining layer for fixing the coil, the side wall portion being attached to the bottom plate portion by a fixation member to structure the case, and the terminal fitting includes, on its one end side, a plurality of joining pieces that are disposed at positions opposing to the end portion of the wire.

12. The reactor component according to claim 11, wherein the joining pieces have a narrow portion where an interval between the joining pieces is smaller than a thickness of the wire.

13. A reactor manufacturing method for manufacturing the reactor according to claim 1, comprising:

preparing the side wall portion to which the terminal fitting is fixed, the terminal fitting including the plurality of joining pieces disposed at positions opposing to the end portion of the wire structuring the coil;

preparing the bottom plate portion exclusive of the side wall portion, the bottom plate portion including the joining layer at its one face;

placing the combined product on the bottom plate portion including the joining layer, and fixing the coil to the bottom plate portion by the joining layer;

disposing the side wall portion on the bottom plate portion so as to surround the periphery of the combined product, and disposing the terminal fitting such that the end portion of the wire is interposed in the space formed by the joining pieces;

attaching the side wall portion to the bottom plate portion by the fixation member to form the case; and electrically connecting at least one of the joining pieces and the end portion of the wire to each other without use of a jig for bringing the joining piece and the end portion of the wire into contact to each other.

* * * * *